US007789482B2

(12) United States Patent
Ishihara

(10) Patent No.: US 7,789,482 B2
(45) Date of Patent: Sep. 7, 2010

(54) WASTE INK LIQUID ABSORBER AND INKJET-TYPE RECORDING APPARATUS INCLUDING THE SAME

(75) Inventor: Dasuke Ishihara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 729 days.

(21) Appl. No.: 11/386,046

(22) Filed: Mar. 21, 2006

(65) Prior Publication Data

US 2006/0238564 A1 Oct. 26, 2006

(30) Foreign Application Priority Data

Mar. 22, 2005 (JP) ..... P.2005-081196
Mar. 29, 2005 (JP) ..... P.2005-094836
Mar. 29, 2005 (JP) ..... P.2005-094837

(51) Int. Cl.
*B41J 2/165* (2006.01)

(52) U.S. Cl. ..... 347/36

(58) Field of Classification Search ..... 347/22, 347/28, 30, 31, 33, 36
See application file for complete search history.

(56) References Cited

U.S. PATENT DOCUMENTS 6,214,099 B1 * 4/2001 Ueda et al. ..... 106/31.57
7,278,726 B2 * 10/2007 Nagai ..... 347/100
7,314,276 B2 * 1/2008 Koike et al. ..... 347/100
7,354,145 B2 * 4/2008 Nito et al. ..... 347/96

FOREIGN PATENT DOCUMENTS

| | | |
|---|---|---|
| JP | 60-147344 | 8/1985 |
| JP | 5-4349 | 1/1993 |
| JP | 5-162334 | 6/1993 |
| JP | 6-255123 | 9/1994 |
| JP | 10-119309 | 5/1998 |
| JP | 2003-80739 | 3/2003 |
| JP | 2004-34361 | 2/2004 |
| JP | 2004-75988 | 3/2004 |
| JP | 2004-268536 | 9/2004 |
| JP | 2004-284171 | 10/2004 |
| JP | 2005-14423 | 1/2005 |
| JP | 2005-15765 | 1/2005 |
| JP | 2005-74889 | 3/2005 |

OTHER PUBLICATIONS

Computer-Generated English Translation of Specification and Claims and Patent Abstracts of Japan of JP 2005-74889 dated Mar. 24, 2005.

(Continued)

*Primary Examiner*—An H Do
(74) *Attorney, Agent, or Firm*—Ladas and Parry LLP

(57) ABSTRACT

A waste ink liquid absorber for a waste ink tank of an inkjet-type recording apparatus, which includes: an impregnation liquid containing at least one of the following: a water-hardly-soluble resin; a water-soluble resin; or both of a moisturizing agent and a base. The impregnation liquid is included at least a part including a surface coming into contact with a waste ink Also, a waste ink tank having the waste ink liquid absorber, and an inkjet-type recording apparatus having the waste ink liquid absorber.

21 Claims, 6 Drawing Sheets

OTHER PUBLICATIONS

Computer-Generated English Translation of Specification and Claims and Patent Abstracts of Japan of JP 2005-15765 dated Jan. 20, 2005.

Computer-Generated English Translation of Specification and Claims and Patent Abstracts of Japan of JP 2005-14423 dated Jan. 20, 2005.

Computer-Generated English Translation of Specification and Claims and Patent Abstracts of Japan of JP 2004-284171 dated Oct. 14, 2004.

Computer-Generated English Translation of Specification and Claims and Patent Abstracts of Japan of JP 2004-268536 dated Sep. 30, 2004.

Computer-Generated English Translation of Specification and Claims and Patent Abstracts of Japan of JP 2004-75988 dated Mar. 11, 2004.

Computer-Generated English Translation of Specification and Claims and Patent Abstracts of Japan of JP 2004-34361 dated Feb. 5, 2004.

Computer-Generated English Translation of Specification and Claims and Patent Abstracts of Japan of JP 2003-80739 dated Mar. 19, 2003.

Computer-Generated English Translation of Specification and Claims and Patent Abstracts of Japan of JP 10-119309 dated May 12, 1998.

Computer-Generated English Translation of Specification and Claims and Patent Abstracts of Japan of JP 6-255123 dated Sep. 13, 1994.

Computer-Generated English Translation of Specification and Claims and Patent Abstracts of Japan of JP 5-162334 dated Jun. 29, 1993.

Computer-Generated English Translation of Specification and Claims and Patent Abstracts of Japan of JP 5-4349 dated Jan. 14, 1993.

Patent Abstracts of Japan of JP 60-147344 dated Aug. 3, 1985.

* cited by examiner

WASTE INK LIQUID ABSORBER AND INKJET-TYPE RECORDING APPARATUS INCLUDING THE SAME

The present application is based on Japanese Patent Applications No. 2005-81196 filed on Mar. 22, 2005, No. 2005-94836 filed on Mar. 29, 2005, and No. 2005-94837 filed on Mar. 29, 2005, and the contents thereof are incorporated herein by reference.

BACKGROUND

1. Technical Field

The present invention relates to a waste ink liquid absorber and inkjet-type recording apparatus including the same.

2. Related Art

In the inkjet-type recording apparatus, flushing was performed for the purpose of preventing an injection nozzle of a recording head from being dried. It is an operation of blank injection of an ink from the injection nozzle independent of recording-controlling signals. Moreover, in the case that the injection nozzle is blocked, a so-called cleaning operation is performed wherein the injection nozzle of the recording head is sealed with a capping means and an ink is compulsorily discharged from the injection nozzle by means of a suction means connected to the capping means. The ink not used for recording and injected from the injection nozzle by these flushing and cleaning was received by the capping means and was conveyed as a waste liquid into a waste liquid tank provided on the inkjet-type recording apparatus by the suction means. Moreover, in margin-less printing, the ink injected to the outside of a recording medium was conveyed to the waste liquid tank via a trapping material provided on a platen.

For example, FIG. 8 shows an inkjet-type recording apparatus equipped with a waste liquid tank for the waste ink derived from the above flushing and cleaning. FIG. 8 is a partial perspective view of the inkjet-type recording apparatus 10 and particularly shows the structure of a printing part 40 and an ink waste liquid-conveying part 70. The printing part 40 has, for example, a carriage 42 on which an ink cartridge is placed, a printing head 44 injecting an ink, a shaft hole 46 provided on the cartridge 42, and a guide shaft 48 which is passed through the shaft hole 46 and slidably supports the carriage 42 in the almost vertical direction toward a feeding direction. The recording head 44 has a plurality of the ink injection nozzles arranged along the feeding direction of the article to be recorded. The printing part 40 further has a timing belt 402, a carriage motor 404, a black ink cartridge 406, and a color ink cartridge 408.

When the carriage motor 404 drives the timing belt 402, the carriage 42 reciprocates almost perpendicularly to the feeding direction of the article 11 to be recorded under a guide of the guide shaft 48. On the side of the carriage 42 opposite to the article to be recorded, a recording head 44 including an injection nozzle for the black ink and an injection nozzle for color inks are mounted. On the upper part of the carriage 42, the black ink cartridge 406 and the color ink cartridge 408 which feed inks to the recording head 44 are detachably mounted.

The inkjet-type recording apparatus 10 is further equipped with the ink waste liquid-conveying part 70 which conveys the ink discharged from the recording head 44 as a waste liquid and a wiping means 80. The ink waste liquid-conveying part 70 has the capping means 72 which seals the injection nozzle of the recording head 44. Furthermore, the ink waste liquid-conveying part 70 has a tube 74 connecting the injection nozzle of the recording head 44 to the capping means 72 and a pump 76 which conveys the ink present inside the tube 74 with elastically deforming a part of the tube 74. The ink waste liquid-conveying part 70 further has a waste liquid tank 100 which accumulates the ink conveyed by the pump 74. The capping means 72 of the ink waste liquid-conveying part 70 is placed at a non-recording region (home position) outside the recording region (feeding pathway of the article 11 to be recorded). The article 11 to be recorded is conveyed by a conveying roller (not shown in the figure) or a discharging roller 52. The wiping means 80 has an elasticity and is placed in the vicinity of the edge part at the recording region side of the capping means 72.

When the inkjet-type recording apparatus 10 having the above constitution does not perform printing, the carriage 42 is moved from the recording region to the non-recording region (home position). When the recording head 44 provided on the carriage 42 is moved just above the home position, the capping means 72 is elevated to the carriage 42 side and the surface having the injection nozzle of the recording head 44 can be sealed.

When the capping means 72 seals the surface having the injection nozzle of the recording head 44, drying of the injection nozzle of the recording head 44 can be suppressed. Moreover, the capping means 72 can receive a blank-injected ink by actuating the flushing operation wherein ink drops are blank-injected from the recording head 44. The flushing is carried out by applying a driving signal irrelevant to recording.

In the state that the capping means 72 seals the recording head 44, an ink is compulsorily sucked and discharged from the recording head 44 by sucking the air in an inner space formed with the recording head 44 and the capping member 72 using the pump 76. By compulsorily sucking and discharging the ink from the injection nozzle of the recording head 44, the recording head 44 is cleaned and the blocking of the injection nozzle is dissolved.

When the carriage 42 returns from the non-recording region to the recording region, it first secedes from the capping means 72. Furthermore, as the carriage 42 moves to the non-recording region side, the wiping means 80 advances onto the moving pathway of the recording head 44 to wipe the ink on the nozzle-forming surface of the recording head 44.

The ink received by the capping means 72 by the above cleaning, flushing, and the like is sucked by the pump 76 of the ink waste liquid-conveying part 70 and is transferred, via the tube 74 whose one end is connected to the capping means 72, to the waste liquid tank 100 which is connected to another end of the tube 74.

When the waste liquid tank 100 is tightly sealed, drying of the waste ink is inhibited and the waste liquid tank is filled with the waste ink in a short period, so that it is difficult to hold an expected amount of the waste ink. On the other hand, when the tank is formed as a tray-like vessel with opening the upper surface of the waste liquid tank in order to enhance the amount of the waste ink to be held, the ink may be scattered by the vibration of the inkjet recording apparatus 10 during recording or the ink may flow out when the inkjet recording apparatus 10 is slanted. Thus, in general, an absorber which absorbs the waste ink is stored in the waste liquid tank 100.

Moreover, the waste liquid tank 100 has an ink-reserving part (i.e., waste ink-diffusing chamber) and an absorber placed at surrounding area of the ink-reserving part (i.e., absorber-holding chamber). After the waste ink conveyed from the tube 74 is reserved in the waste ink-diffusing chamber, the waste ink is absorbed from an absorbing surface of the absorber. However, among the components contained in the waste ink liquid, a colorant component is difficult to absorb as compared with a solvent component and a water component. Particularly, in a pigment ink wherein the coloring component of the ink is a pigment, only the solvent component and water component permeate inside the absorber and the pigment particles tend to deposit on the surface of the absorber.

In an aqueous pigment ink, there has been developed an aqueous pigment ink containing a water-insoluble dispersible polymer (e.g., Document 2) mainly for the purpose of improving coloring properties on standard paper (e.g., Document 1) and both of coloring properties and glossiness on standard paper. Moreover, various improvements have been proposed on the structure of the waste liquid tank of the inkjet recording apparatus and, for example, a technology of slanting the bottom of the waste ink-diffusing chamber of the waste liquid tank is known (e.g., Document 3).

[Document 1] JP-A-2005-15765

[Document 2] JP-A-2004-75988

[Document 3] JP-A-2004-34361

In the inkjet recording apparatus using the aqueous pigment ink described in the above Documents 1 and 2, there has been generated a phenomenon that the waste ink is more difficult to absorb into the absorber in the waste ink tank as compared with a conventional pigment ink. Specifically, in the pigment particles dispersed by the water-insoluble polymer, there is a tendency that only the solvent component and water component permeate inside the absorber and the pigment particles are apt to deposit on the surface of the absorber, as compared with conventional pigment particles. Furthermore, since the waste ink discharged from the waste liquid tube into the waste ink-diffusing chamber in the waste ink tank foams, it is further difficult to absorb the ink into the absorber when the foam remains. Finally, since the waste ink is deposited inside the waste liquid tube, flushing and cleaning cannot be carried out even when a sufficient absorbing ability remains in the absorber itself.

SUMMARY

An advantage of some aspects of the invention is to provide a technology of easily absorbing the waste ink discharged from a waste liquid tube in a waste liquid tank of an inkjet recording apparatus even when the waste ink foams. In particular, it is to provide a technology of easily absorbing the waste ink even when a pigment ink containing a water-insoluble dispersible polymer is used.

Furthermore, other advantages and effects of some aspect of the invention will become apparent from the following description.

The present inventors have made eager investigation to examine the problem. As a result, it has been found that the foregoing advantages can be attained by the following constitution. The present invention is mainly directed to the following items:

(1) A waste ink liquid absorber for a waste ink tank of an inkjet-type recording apparatus, which comprising: an impregnation liquid containing at least one selected from the group consisting of a water-hardly-soluble resin; a water-soluble resin; and both of a moisturizing agent and a base; the impregnation liquid being included at least a part including a surface coming into contact with a waste ink.

(2) The waste ink liquid absorber according to (1), wherein the water-hardly-soluble resin contains a water-hardly-soluble resin obtained by polymerizing at least one monomer selected from the group consisting of acrylic monomers, methacrylic monomers, vinylic monomers, maleic acid, maleic anhydride, styrene, itaconic acid, N-vinylpyrrolidone, acrylamide, methacrylamide, and derivatives thereof.

(3) The waste ink liquid absorber according to (2), wherein the methacrylic monomer is at least one monomer selected from the group consisting of methyl methacrylate (MMA), ethyl methacrylate (EMA), propyl methacrylate, n-butyl methacrylate (BMA or NBMA), hexyl methacrylate, 2-ethylhexyl methacrylate (EHMA), octyl methacrylate, lauryl methacrylate (LMA), stearyl methacrylate, phenyl methacrylate, hydroxyethyl methacrylate (HEMA), hydroxypropyl methacrylate, ethoxytriethylene glycol methacrylate (ETEGMA), 2-ethoxyethyl methacrylate, methacrylonitrile, 2-trimethylsiloxyethyl methacrylate, glycidyl methacrylate (GMA), p-tolyl methacrylate, methacrylic acid (MMA), diethylaminoethyl methacrylate (DMAEMA), diethylaminoethyl methacrylate, t-butylaminoethyl methacrylate, and sorbyl methacrylate.

(4) The waste ink liquid absorber according to (2), wherein the acrylic monomer is at least one monomer selected from the group consisting of methyl acrylate, ethyl acrylate, propyl acrylate, butyl acrylate, hexyl acrylate, 2-ethylhexyl acrylate, octyl acrylate, lauryl acrylate, stearyl acrylate, phenyl acrylate, hydroxyethyl acrylate, hydroxypropyl acrylate, acrylonitrile, 2-trimethylsiloxyethyl acrylate, glycidyl acrylate, p-tolyl acrylate, sorbyl acrylate, acrylic acid, dimethylaminoethyl acrylate, and diethylaminoethyl acrylate.

(5) The waste ink liquid absorber according to (1), wherein the water-soluble resin is a compound having a hydrophilic structural part and a hydrophobic structural part.

(6) The waste ink liquid absorber according to (1), wherein the moisturizing agent is a polyol having a vapor pressure at 20° C. of 0.01 mmHg or lower.

(7) The waste ink liquid absorber according to (1), wherein the base is an alkanolamine or an inorganic base.

(8) The waste ink liquid absorber according to (1), which further contains a water-soluble solvent.

(9) The waste ink liquid absorber according to (8), wherein at least one of the water-soluble solvent has a vapor pressure at 20° C. of 0.01 mmHg or lower.

(10) The waste ink liquid absorber according to (1), wherein the impregnation liquid further contains an antiseptic.

(11) The waste ink liquid absorber according to (1), which comprises a nonwoven fabric or a foam.

(12) The waste ink liquid absorber according to (11), wherein the nonwoven fabric contains a regenerated cellulose fiber and/or a polyacrylic fiber.

(13) The waste ink liquid absorber according to (11), which has a saturated polyester film layer on at least a part of the surface.

(14) A waste ink tank comprising: a waste ink-diffusing chamber not to be packed with a waste ink liquid absorber; and an absorber-supporting chamber to be packed with a waste ink liquid absorber, the waste ink liquid absorber according to (1) being packed into the absorber-supporting chamber.

(15) The waste ink tank according to (14), which the waste liquid absorber has a waste ink liquid absorber protruded part extending from the surface of the waste ink liquid absorber toward the inside of the waste ink-diffusing chamber, and wherein the waste ink liquid absorber protruded part contains at least the impregnation liquid.

(16) The waste ink tank according to (15), wherein the waste ink liquid absorber protruded part is formed of a polyurethane foam.

(17) The waste ink tank according to (14), wherein the waste ink-diffusing chamber is surrounded with the bottom of the waste ink tank, the upper surface of the waste ink liquid absorber, and four side surfaces thereof.

(18) An inkjet-type recording apparatus comprising: the waste ink liquid absorber according to (1); and an ink composition containing at least: a pigment; a polymer containing the pigment, being enable the pigment to disperse in the ink composition, having a hydrophobic group and a hydrophilic group, and being substantially not dissolved in the ink composition; and water as a main solvent.

(19) The inkjet-type recording apparatus according to (18), wherein the polymer is a vinyl polymer obtained by polymerizing: (A) 5 to 45% by weight of at least one monomer selected from: monomer A1 represented by the following formula (I):

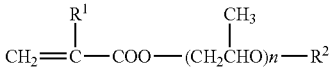

(I)

wherein R1 represents a hydrogen atom or a methyl group, R2 represents a hydrogen atom or an alkyl group having 1 to 20 carbon atoms, and n represents a numeral of 1 to 30; a monomer A2 represented by the following formula (II):

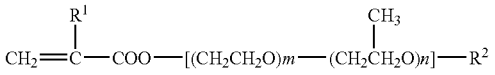

(II)

wherein R1, R2, and n represent the same meanings as defined in the formula (I), m represents a numeral of 1 to 30, and the oxyethylene group and oxypropylene group in the parenthesis [ ] may be any of block or random addition; and a monomer A3 represented by the following formula (III):

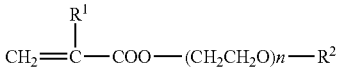

(III)

wherein R1, R2, and n represent the same meanings as defined in the formula (I); (B) 3 to 40% by weight of a monomer having a salt-forming group; (C) 5 to 40% by weight of a macromonomer having a number-average molecular weight of 500 to 500,000; and (D) 0 to 87% by weight of a monomer copolymerizable with the monomers (A), (B), and (C).

(20) The inkjet-type recording apparatus according to (18), wherein the polymer is a vinyl polymer obtained by polymerizing: (1) the monomer A3; and (2) at least one monomer selected from the group consisting of the monomer A1, the monomer A2 and a monomer A4 represented by the following formula (IV):

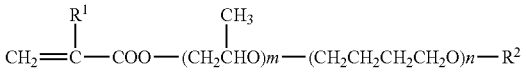

(IV)

wherein R1, R2, m, and n represent the same meanings as defined above, and the oxyethylene group and the oxypropylene group is in a form of block addition or random addition; (3) the monomer (B) having a salt-forming group; and (4) a monomer copolymerizable with the monomers A1, A2, A3, A4, (B), and (C).

In this regard, the terms relating to a "up and down" relation with regard to a printer herein, e.g., "upward" or "downward", "upper surface" or "lower surface", "upper side" or "lower side", furthermore "upper part" or "just above", and the like mean a up and down relation with regard to the gravitational direction in a state that printing is performed by a printer.

DESCRIPTION OF EXEMPLARY EMBODIMENTS

With regard to the waste ink liquid absorber of the invention, a waste ink tank which can be used with housing the waste ink liquid absorber is first explained. Subsequently, the explanation of the structure and material of the waste ink liquid absorber and the explanation of a impregnating liquid, ink compositions, and the like are described in sequence.

(A) Waste Ink Tank

The waste ink tank which can be used with housing the waste ink liquid absorber of the invention is not particularly limited as far as it is a waste ink tank which houses a waste ink generated in each operation of flushing and cleaning carried out in an inkjet-type recording apparatus. Furthermore, it includes a waste ink tank housing a waste ink which is injected outside a recording medium in margin-less printing and is conveyed via a trapping material provided on a platen and also a waste ink tank which satisfies these functions at the same time. The waste ink tank to be used in the invention may be closed or opened and is preferably opened.

The waste ink tank to be used in the invention has a waste ink-diffusing chamber and an absorber-holding chamber and the absorber-holding chamber is preferably packed with a waste ink liquid absorber to be mentioned below. The waste ink-diffusing chamber herein is an inner space containing no waste ink liquid absorber and is an inner space into which a discharging outlet of a waste liquid tube introducing the waste ink generated in each operation of flushing and cleaning into the waste ink tank is inserted. Moreover, the absorber-holding chamber is an inner space into which the waste ink liquid absorber is packed.

Figure 1:
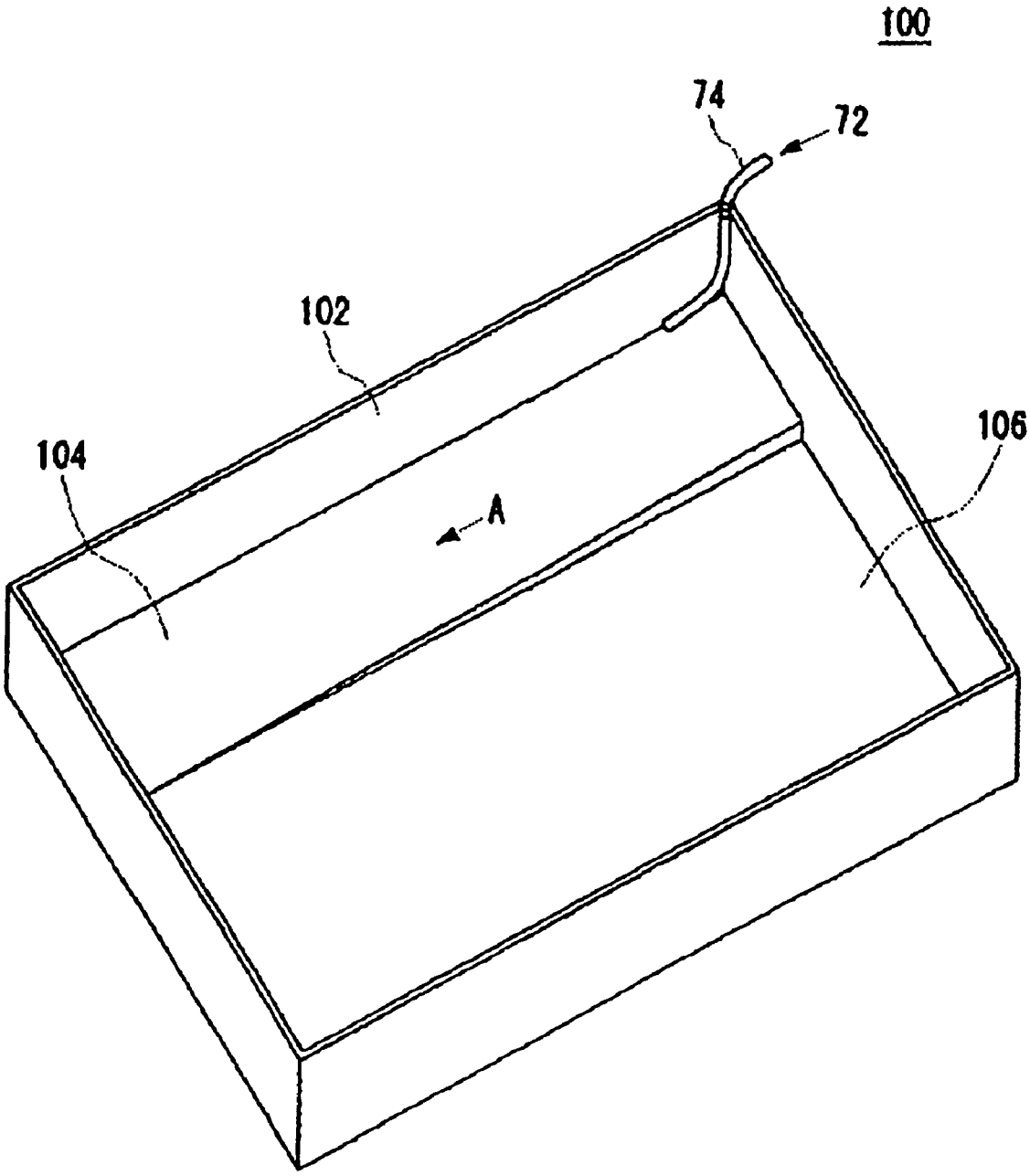
FIG. 1 is a perspective view showing a state that, from a waste ink tank having a waste ink-diffusing chamber and an absorber-holding chamber, an absorber packed into the absorber-holding chamber is removed.
Figure 2:
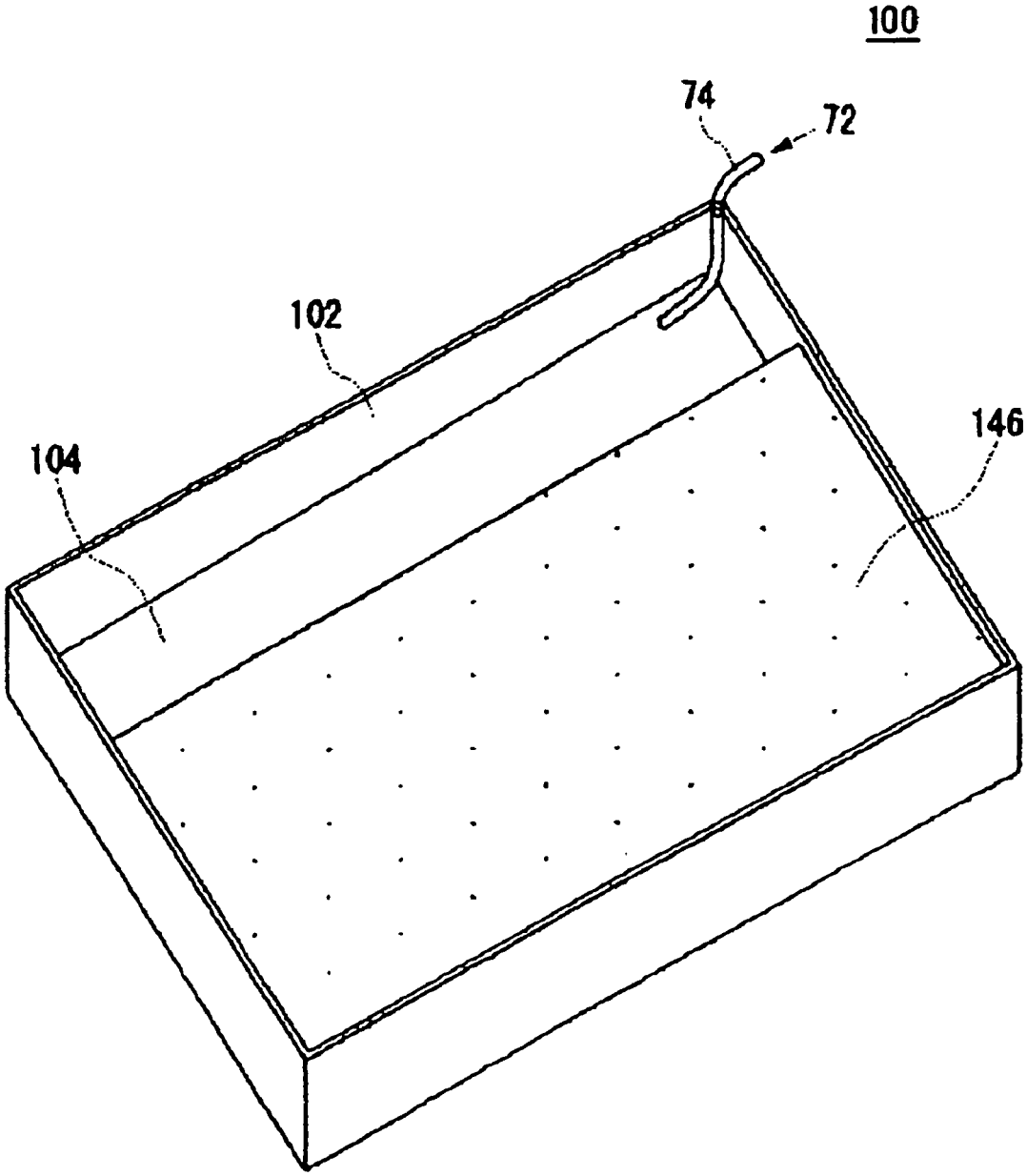
FIG. 2 is a perspective view showing a state that an absorber is packed into the absorber-holding chamber of the waste ink tank in FIG. 1.

FIG. 1 is a perspective view showing a state that, from a waste ink tank 100 having a waste ink-diffusing chamber and an absorber-holding chamber, an absorber packed into the absorber-holding chamber being removed. FIG. 2 is a perspective view showing a state that an absorber 146 is packed into the absorber-holding chamber of the waste ink tank 100 in FIG. 1.

The waste ink tank 100 has a main body 102 of near cuboid wherein the whole upper surface is opened. The waste ink tank 100 possesses a waste ink-diffusing chamber 104 having a slant bottom for transferring the waste ink and an absorber-holding chamber 106 which is provided on the side surface of the waste ink-diffusing chamber 104 along the waste ink-diffusing chamber 104 and holds the waste ink liquid absorber 146. The waste ink-diffusing chamber 104 is opened at its upper part and is slanted in the direction of transferring the ink (the direction of the arrow A in the figure). The absorber-holding chamber 106 is provided so that its bottom is lower than the waste ink-diffusing chamber 104, and has a tray-shape wherein the upper surface is opened. A waste ink is conveyed from a capping means 72 into the waste ink tank 100 via a tube 74. When the waste ink is transferred to the waste ink-diffusing chamber 104, the ink flows downward along the slant bottom of the waste ink-diffusing chamber 104, i.e., in the direction of the arrow A in FIG. 1. In this regard, the bottom of the waste ink-diffusing chamber 104 may be horizontal or may be slanted toward the direction of the absorber-holding chamber 106.

Figure 3:
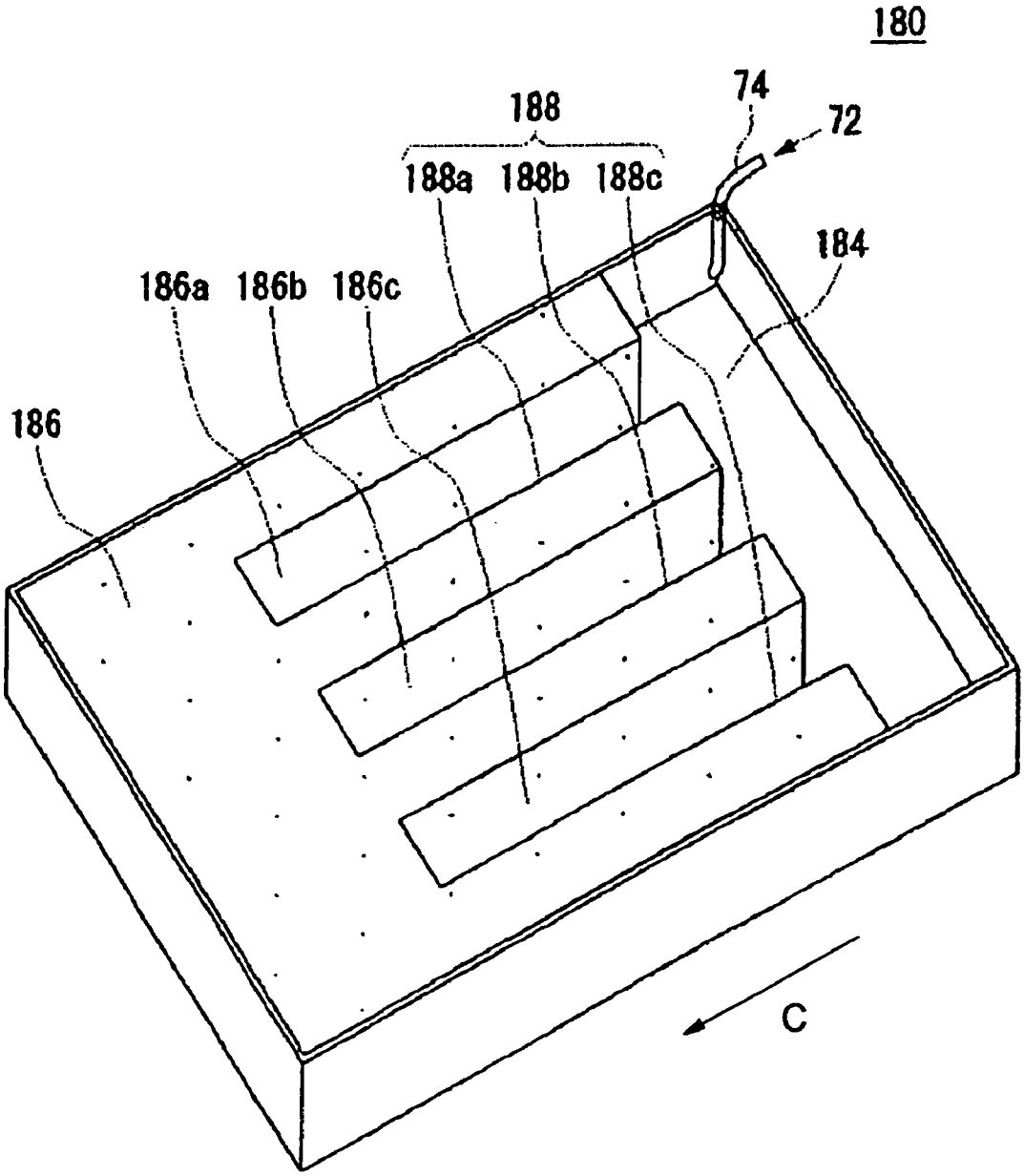
FIG. 3 is a perspective view showing another example of a waste tank.

FIG. 3 is a perspective view showing another example of a waste tank. The waste liquid tank 180 shown in FIG. 3 has a near cuboid wherein the whole upper surface is opened. The waste liquid tank 180 has a waste ink-diffusing chamber 184 and an absorber-holding chamber which is provided on the side surface of the waste ink-diffusing chamber 184 along the waste ink-diffusing chamber 184 and the absorber-holding chamber contains an absorber 186. The waste ink-diffusing chamber 184 is opened at its upper part. In the waste liquid tank 180, ink waste liquid sub-pathways 188*a*, 188*b*, and 188*c* are arranged, which introduce the ink in the direction which crosses with the waste ink-diffusing chamber 184 (the direction of the arrow C in FIG. 3). These ink waste liquid sub-pathways 188*a*, 188*b*, and 188*c* are opened at their upper surface and may have a slant bottom which is lower as it comes away from the waste ink-diffusing chamber 184 or may have a horizontal bottom.

The waste ink-diffusing chamber to be used in the invention may be an embodiment wherein the above waste ink-diffusing chamber is surrounded with the bottom of the waste ink tank and the upper surface and four side surfaces of the waste ink liquid absorber.

Figure 4:
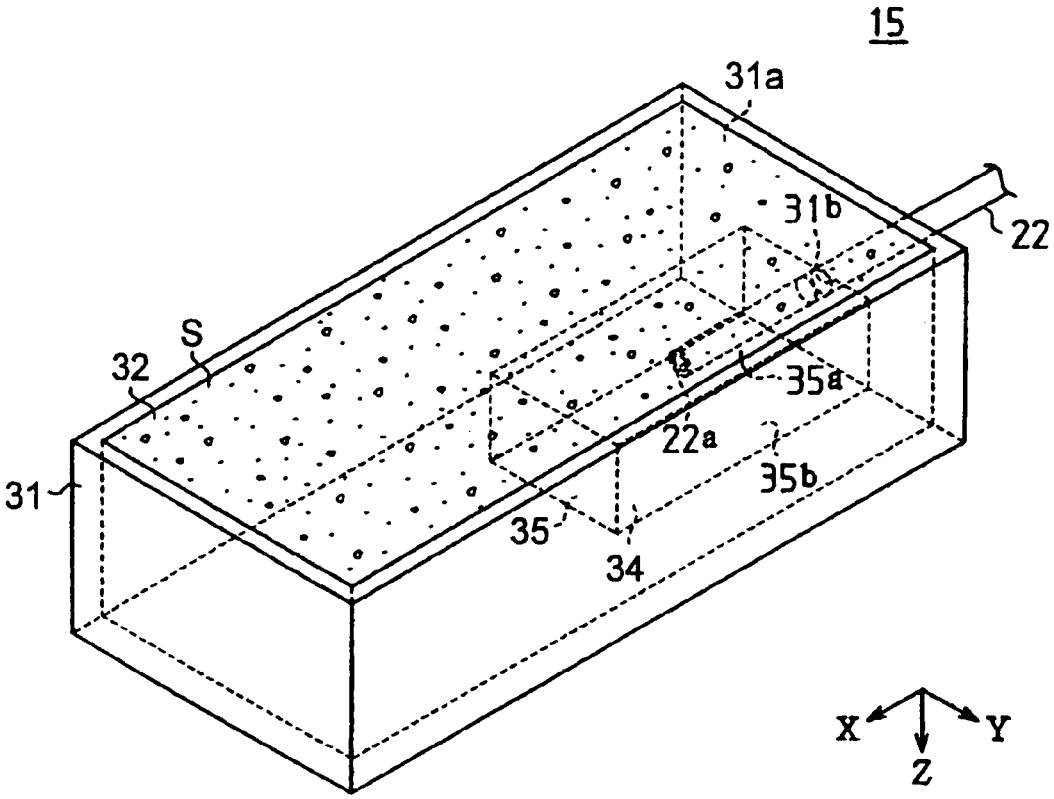
FIG. 4 is a perspective view of a waste ink tank having a waste ink-diffusing chamber surrounded with the bottom of a waste ink tank and the upper surface and four side surfaces of a waste ink liquid absorber.
Figure 5:
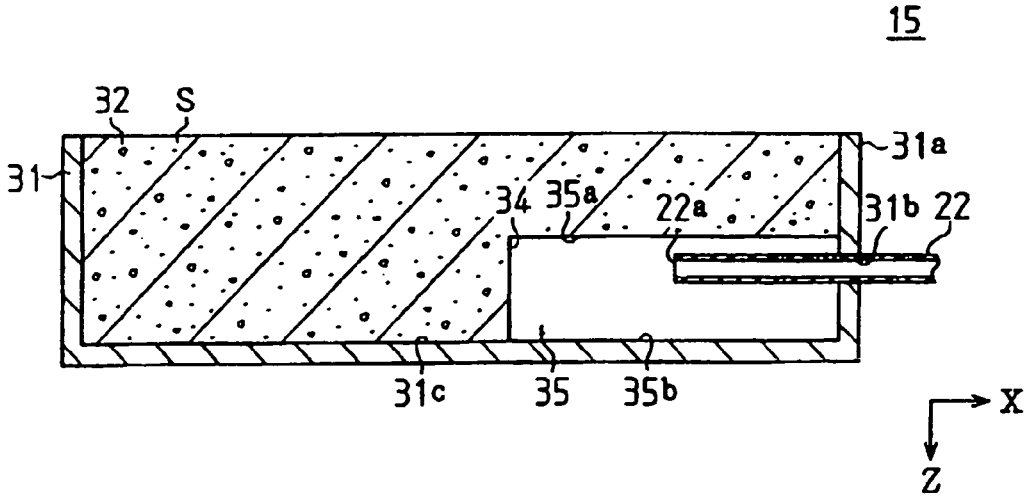
FIG. 5 is a cross-sectional view of the waste ink tank in FIG. 4.

A waste liquid tank containing a waste ink-diffusing chamber of such an embodiment is shown in FIG. 4 (perspective view) and FIG. 5 (cross-sectional view).

As shown in FIG. 4 and FIG. 5, the waste liquid tank 15 is equipped with a collection vessel 31 and a waste ink liquid absorber 32. The collection vessel 31 is a box vessel whose upper surface is opened. At the inside of the collection vessel 31, a collection space S of a near cuboid is formed. At the right side surface 31*a* of the collection vessel 31, a through hole 31*b* is provided as shown in FIG. 4 and FIG. 5. The through hole 31*b* is a circular hole formed along the left and right directions X and is formed from the outside of the collection vessel 31 passing through to the collection space S. Moreover, the through hole 31*b* is formed in the vicinity of the center of the right side surface 31*a* and is formed in a hole diameter about the same as the outer diameter of the discharge tube 22.

As shown in FIG. 4, the waste liquid tank is equipped with the collection vessel 31 and the waste ink liquid absorber 32. The collection vessel 31 is a box vessel whose upper surface is opened as shown in FIG. 4. At the inside of the collection vessel 31, a collection space S of a near cuboid is formed. At the right side surface 31*a* of the collection vessel 31, a through hole 31*b* is provided as shown in FIG. 4 and FIG. 5. The through hole 31*b* is, for example, a circular hole and is formed from the outside of the collection vessel 31 passing through to the collection space S. Moreover, the through hole 31*b* is formed in the vicinity of the center of the right side surface 31*a* and is formed in a hole diameter about the same as the outer diameter of the discharge tube 22.

Through the through hole 31*b*, as shown in FIG. 4, a discharge tube 22 is passed. At one end of the discharge tube 22, a toric discharge outlet 22*a* for discharging the waste ink is formed. By arranging the discharge outlet 22*a* in the collection space S, the discharge tube 22 is enabled to discharge the waste ink into the collection space S (waste liquid tank) via the discharge outlet 22*a*.

In the collection space S, as shown in FIG. 4, the waste ink liquid absorber 32 is housed. The waste ink liquid absorber 32 is formed of a porous member possessing a large number of micropores and is formed as a cuboid having a size about the same as the collection space S. The waste ink liquid absorber 32 can absorb the discharged ink inside the micropores by the action of capillary attraction or the like. In addition, the waste ink liquid absorber 32 can vaporize the absorbed ink in a predetermined vaporization ratio through the upper opening of the collection vessel 31. Namely, the waste ink liquid absorber 32 can vaporize the absorbed waste ink in an amount corresponding to its vaporization ratio and can contain the ink inside the micropores with reducing the volume of the ink.

With regard to the waste ink liquid absorber 32, the maximum capacity (saturation amount) of the ink containable corresponds to the total volume of the micropores and may be, for example, 50 times a unit discharge volume, i.e., the total volume of the waste ink discharged by 50 times of the cleaning operations. In addition, the waste ink liquid absorber 32 may contain the absorbed ink at a vaporization ratio of 50%, i.e., with reducing the volume to a half. In this case, the waste ink liquid absorber 32 (waste liquid tank) may be filled with the ink in an amount 50 times a unit discharge volume, which corresponds to the saturation amount by performing 100 times of the cleaning operations and vaporizing 50% of the waste ink. In other words, the waste liquid tank can made the number of cleaning times through which the amount of the ink contained reaches the saturation amount (saturated cleaning times) 100 times.

In the position present at the right side surface of the waste ink liquid absorber 32 and corresponding to the through hole 31*b*, as shown in FIG. 4 and FIG. 5, a concave part 34 is formed. The concave part 34 is concavely provided by notching a lower central part of the right side surface 31*a* of the waste ink liquid absorber 32 toward left side. By forming the concave part 34, in the collection space S, a space housing the discharge outlet 22*a* and covered with the waste ink liquid absorber 32 (concave part 34), i.e., a waste ink-diffusing chamber 35 is formed with partitioning. Moreover, by forming the waste ink-diffusing chamber 35, in the collection space S, as shown in FIG. 4 and FIG. 5, a space filled with the waste ink liquid absorber 32 excluding the waste ink-diffusing chamber 35, i.e., a absorber-holding chamber is formed.

The waste ink-diffusing chamber 35 is a cuboid space formed by the concave part 34 and the inner wall of the collection vessel 31 as shown in FIG. 4 and FIG. 5. The upper surface 35*a* and the lower surface 35*b* of the waste ink-diffusing chamber 35 are formed with the upper surface of the concave part 34 and the bottom 31*c* of the collection vessel 31, respectively. For example, the volume of the waste ink-diffusing chamber 35 may be in a size that the waste ink is not leaked out by 5 times of continuous cleaning operations, i.e., a size capable of containing the waste ink in an amount corresponding to 5 times a unit discharge volume.

As shown in FIG. 5, the discharge outlet 22*a* is provided between the upper surface 35*a* and the lower surface 35*b* of the waste ink-diffusing chamber 35. As shown in FIG. 4 and FIG. 5, the discharge outlet 22*a* is preferably arranged so that the center is present at the center of the horizontal direction of the waste ink-diffusing chamber 35 and is positioned at the center of the cross direction thereof.

When a waste ink is discharged from the discharge outlet 22*a*, the waste ink drops owing to its own weight and poured onto the lower surface 35*b* opposing to the discharge outlet 22*a*. Then, the discharged ink poured onto the lower surface 35*b* isotropically diffuses from the center to the outside along the lower surface 35*b* owing to the adhesive force or the like. Finally, most of the discharged ink diffusing the lower surface 35*b* diffuses to the outside (absorber-holding chamber side) of the waste ink-diffusing chamber 35 along the bottom 31*c* of the collection vessel 31 and is absorbed and contained in the absorber-holding chamber by the action of capillary attraction of the waste ink liquid absorber 32.

Figure 6:
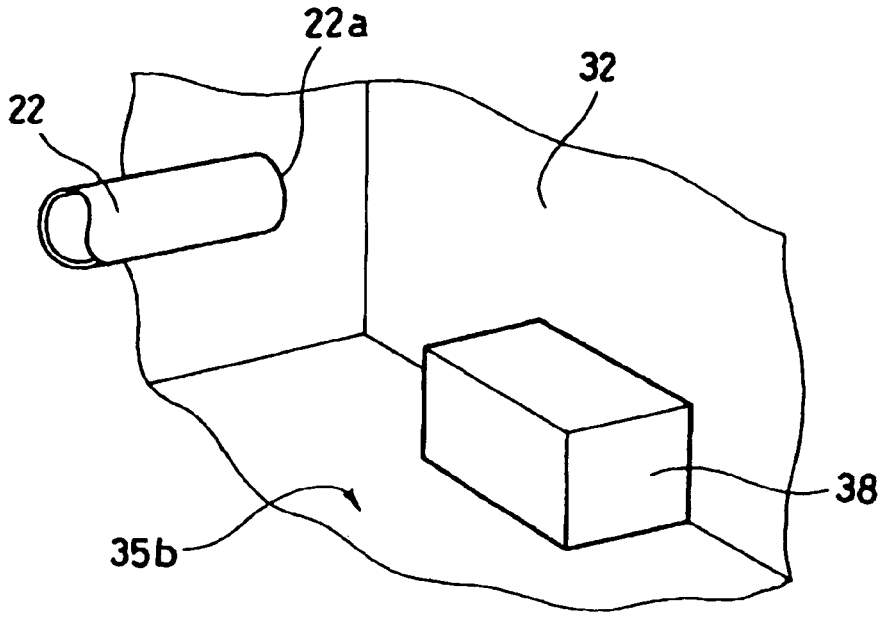
FIG. 6 is a partial perspective view of a waste ink tank containing a waste ink liquid absorber having a waste ink liquid absorber protruded part.
Figure 7:
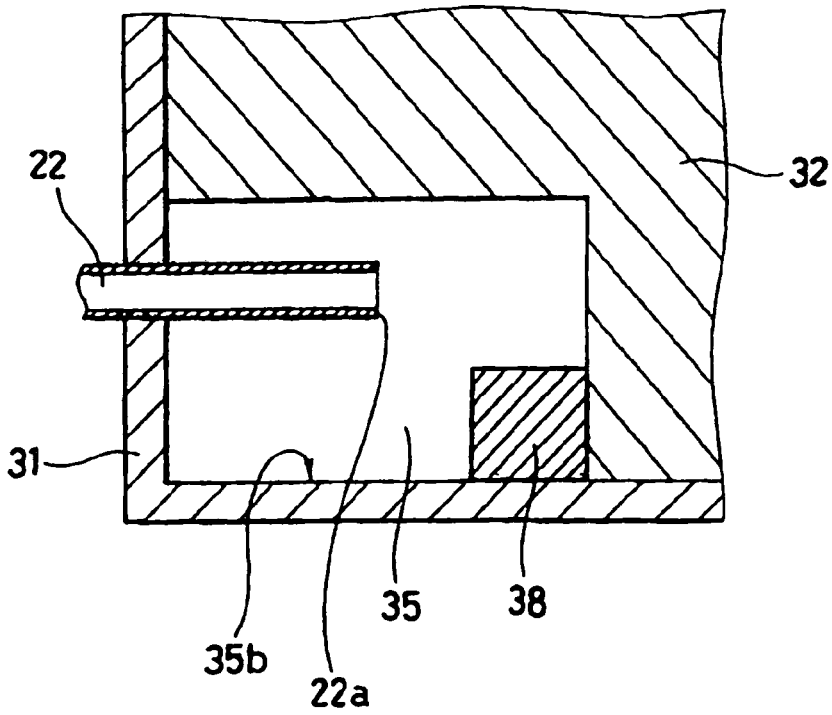
FIG. 7 is a partial cross-sectional view of the waste ink tank in FIG. 6.
Figure 8:
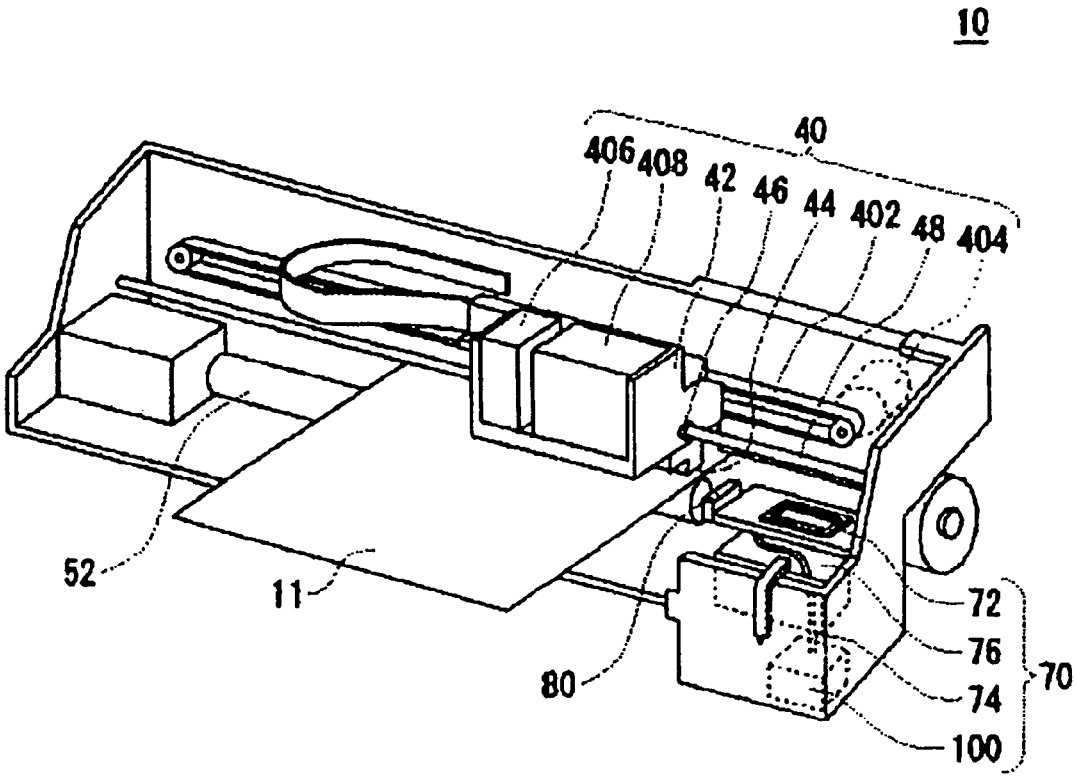
FIG. 8 is a partial perspective view of an inkjet-type recording apparatus equipped with a waste liquid tank for waste ink.

The waste ink liquid absorber to be used in the invention preferably has a waste ink liquid absorber protruded part extending from the surface of the waste ink liquid absorber coming into contact with the waste ink-diffusing chamber toward the inside of the waste ink-diffusing chamber. Moreover, the waste ink liquid absorber protruded part preferably contains at least an impregnation liquid to be described below. The embodiment having the waste ink liquid absorber protruded part is shown in FIG. 6 and FIG. 7. FIG. 6 is a schematic partial expanded perspective view of the waste ink liquid absorber protruded part 38 provided on the side surface of the waste ink liquid absorber 32 exposed in the waste ink-diffusing chamber 35 together with the discharge outlet 22*a* of the waste liquid tube 22 and FIG. 7 is a cross-sectional view thereof. In this regard, the waste ink liquid absorber protruded part preferably comprises a urethane foam.

The shape of the waste ink liquid absorber protruded part is not particularly limited and may be any shape, for example, a prismatic shape, a columnar shape, a semi-columnar shape, a pyramidal shape, a hemispherical shape, or the like. The number of the waste ink liquid absorber protruded part provided at the inside of one waste ink-diffusing chamber is also not particularly limited and two or more thereof may be provided.

(B) Waste Ink Liquid Absorber

The waste ink liquid absorber to be used in the invention may be formed of, for example, a nonwoven fabric or foam.

The material of the waste ink liquid absorber may be a material exactly the same as the material of the conventionally known waste ink liquid absorber. The nonwoven fabric preferably contains a regenerated cellulose fiber and/or a polyacrylic fiber. For example, since the regenerated cellulose fiber (particularly, rayon fiber) has an excellent water-absorbability, it is preferable to use it as a constituent fiber. Moreover, among polyacrylic fibers, it is also preferable to use those having an excellent water-absorbability and the use of the polyacrylic fiber is preferable also in view of improvement of flame retardancy and easiness of cutting. A nonwoven fabric exclusively composed of a regenerated cellulose fiber (particularly, rayon fiber) is excellent in view of water-absorbability and it can be suitably used. However, since it becomes too soft and is easy to nap and difficult to handle at its cutting or the like, it is more preferred to use the regenerated cellulose fiber and the polyacrylic fiber as a mixture. For example, a combination of 20 to 60% by weight (particularly 30 to 50% by weight) of the regenerated cellulose fiber (particularly, rayon fiber) and 80 to 40% by weight (particularly 70 to 50% by weight) of the polyacrylic fiber is particularly preferred.

For the waste ink liquid absorber according to the invention, the ability to hold a larger amount of the waste ink liquid and the ability to completely hold the waste ink even when a printer is slanted at 90° are required. When drying of the waste ink in the waste ink liquid absorber proceeds, it is possible to hold the ink but the holding amount of the waste ink decreases. Moreover, when the degree of drying of the waste ink is low, the holding amount of the waste ink increases but complete holding of the waste ink is impossible and the waste ink leaks out when slanted. In order to satisfy such both abilities, it is possible to permeate the waste ink through capillary phenomenon by incorporating a small amount of a saturated polyester fiber (e.g., polyethylene terephthalate fiber) into the above nonwoven fabric. Furthermore, for the waste ink liquid absorber to be used in the invention, it is possible to prevent the drying of the absorbed waste ink by providing a saturated polyester film layer on at least a part of the surface of the above nonwoven fabric. As the saturated polyester, for example, polyethylene terephthalate is preferred.

As the foam, it is possible to use a resin foam, preferably a polyurethane foam (particularly, soft polyurethane foam). The soft polyurethane foam to be used preferably has a density of from 0.005 to 0.150 g/cm$^3$, particularly from 0.01 to 0.05 g/cm$^3$ and a cell number of from 40 to 150 cells/25 mm, particularly from 60 to 150 cells/25 mm. When the soft polyurethane foam is used after compression, the cell number is preferably from 20 to 150 cells/25 mm, more preferably from 40 to 150 cells/25 mm, further preferably from 40 to 100 cells/25 mm. The above soft polyurethane foam may be used as it is without compression (non-compressed foam) or after compressed (compressed foam).

When the waste ink liquid absorber according to the invention has a waste ink liquid absorber protruded part, it is preferable to use a nonwoven fabric for the main part of the waste ink liquid absorber and a polyurethane foam (particularly, soft polyurethane foam) for the protruded part.

(C) Impregnation Liquid

The impregnation liquid of the invention contains at least one selected from the group consisting of a water-hardly-soluble resin; a water-soluble resin; and both of a moisturizing agent and a base.

The following will explain first embodiment and second embodiment of the impregnation liquid of the invention.

The impregnation liquid in the first embodiment of the invention contains at least one resin selected from the group consisting of a water-hardly-soluble resin and a water-soluble resin.

The water-hardly-soluble resin to be used in the invention may be incorporated into the impregnation liquid of the invention in the form of an aqueous emulsion polymer.

The water-hardly-soluble resin to be used in the invention may be prepared from at least one monomer selected from the group consisting of acrylic monomers; methacrylic monomers; vinylic monomers (e.g., vinyl acetate or vinyl chloride); maleic acid; maleic anhydride; styrene; itaconic acid; N-vinylpyrrolidone; acrylamide; methacrylamide; and derivatives thereof.

Representative acrylic or methacrylic monomers include methyl methacrylate (MMA), ethyl methacrylate (EMA), propyl methacrylate, n-butyl methacrylate (BMA or NBMA), hexyl methacrylate, 2-ethylhexyl methacrylate (EHMA), octyl methacrylate, lauryl methacrylate (LMA), stearyl methacrylate, phenyl methacrylate, hydroxyethyl methacrylate (HEMA), hydroxypropyl methacrylate, ethoxytriethylene glycol methacrylate (ETEGMA), 2-ethoxyethyl methacrylate, methacrylonitrile, 2-trimethylsiloxyethyl methacrylate, glycidyl methacrylate (GMA), zonyl fluoromethacrylate, p-tolyl methacrylate, sorbyl methacrylate, methyl acrylate, ethyl acrylate, propyl acrylate, butyl acrylate, hexyl acrylate, 2-ethylhexyl acrylate, octyl acrylate, lauryl acrylate, stearyl acrylate, phenyl acrylate, hydroxyethyl acrylate, hydroxypropyl acrylate, acrylonitrile, 2-trimethylsiloxyethyl acrylate, glycidyl acrylate, p-tolyl acrylate, sorbyl acrylate, methacrylic acid (MMA), acrylic acid, diethylaminoethyl methacrylate (DMAEMA), diethylaminoethyl methacrylate, t-butylaminoethyl methacrylate, dimethylaminoethyl acrylate, diethylaminoethyl acrylate, dimethylaminopropylmethacrylamide, methacrylamide, acrylamide, and dimethylacrylamide. Preferred acrylic or methacrylic monomers include water-hardly-soluble resins prepared from methyl methacrylate, butyl methacrylate, 2-ethylhexyl methacrylate, a combination of butyl methacrylate and methyl methacrylate, methacrylic acid, or dimethylaminoethyl methacrylate.

The water-hardly-soluble resin to be used in the invention may contain a small amount of a crosslinkable monomer such as ethylene glycol dimethacrylate or ethylene glycol triacrylate in a small amount. Moreover, the above water-hardly-soluble resin may further contain a hydrophilic monomer represented by the general formula:

$$CH_2{=}C(X)(Y')$$

wherein X is H or $CH_3$, Y' is C(O)OH, $C(O)NR^2R^3$, $C(O)OR^4NR^2R^3$, $C(O)OR^5$, or a salt thereof, $R_2$ and $R_3$ are each independently H or an alkyl group having 1 to 9 carbon atoms, an aryl group, or an alkylaryl group, $R^4$ is an alkylene group having 1 to 5 carbon atoms, and $R^5$ is an alkylene group having 1 to 20 carbon atoms and optionally containing a hydroxy group or an ether group, whereby the solubility can be changed to some extent. However, the hydrophilic monomer should not be present in the water-hardly-soluble resin in an amount sufficient to make the water-hardly-soluble resin or a salt thereof completely water-soluble.

The water-hardly-soluble resin to be used in the invention can be also stabilized with a monomeric or polymeric stabilizer. Useful monomeric stabilizer includes N,N,N-trimethyl-1-dodecaninium chloride, dimethyl-dodecaninium chloride, polyethylene glycol derivatives of alkylphenols, sodium lauryl sulfate, and N-alkyltrimethylammonium chloride. As a commercial monomeric stabilizer, dodecyltrimethylammonium chloride [Arquad (registered trademark); Akzo Chemicals Inc.] may be mentioned, for example. Useful polymeric stabilizer includes constitutive polymers selected from the group consisting of block polymers such as diblock and triblock polymers and graft polymers. As a useful diblock polymer, a compound disclosed in U.S. Pat. No. 5,085,698 can be used, for example. Moreover, as a useful triblock polymer, a compound disclosed in U.S. Pat. No. 5,519,085 can be used, for example. As a useful graft polymer, a compound disclosed in U.S. Pat. No. 5,231,131 can be used, for example.

The water-soluble resin to be used in the invention is preferably, for example, a compound having a hydrophilic structure part and a hydrophobic structure part. Specifically, as the water-soluble resin, an addition polymer, a condensation polymer, and the like may be mentioned. As the addition polymer, an addition polymer of a monomer having an α,β-ethylenically unsaturated group may be mentioned, for example. As the addition polymer, a polymer obtained by copolymerization with suitably combining a monomer having an α,β-ethylenically unsaturated group having a hydrophilic group and a monomer having an α,β-ethylenically unsaturated group having a hydrophobic group can be used, for example. Moreover, a homopolymer of a monomer having an α,β-ethylenically unsaturated group having a hydrophilic group can be also used.

As the monomer having an α,β-ethylenically unsaturated group having a hydrophilic group, there may be used, for example, a monomer having a carboxyl group, a sulfonic acid group, a hydroxyl group, or a phosphoric acid group, e.g., acrylic acid, methacrylic acid, crotonic acid, itaconic acid, itaconic acid monoester, maleic acid, maleic acid monoester, fumaric acid, fumaric acid monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethyleneglycol dimethacrylate, or the like.

On the other hand, as the monomer having an α,β-ethylenically unsaturated group having a hydrophobic group, there may be used, for example, a styrene derivative such as styrene, α-methylstyrene, or vinyltoluene, vinylcyclohexane, vinylnaphthalene, a vinylnaphthalene derivative, an acrylic acid alkyl ester, acrylic acid phenyl ester, a methacrylic acid alkyl ester, methacrylic acid phenyl ester, a methacrylic acid cycloalkyl ester, a crotonic acid alkyl ester, an itaconic acid dialkyl ester, or a maleic acid dialkyl ester.

The copolymer obtained by copolymerizing the above monomers having a hydrophilic group and a hydrophobic group may be a polymer having any structure, such as a random, block, or graft copolymer. As examples of preferred copolymers, there may be mentioned a styrene-styrenesulfonic acid copolymer, a styrene-maleic acid copolymer, a styrene-methacrylic acid copolymer, a styrene-acrylic acid copolymer, a vinylnaphthalene-maleic acid copolymer, a vinylnaphthalene-methacrylic acid copolymer, a vinylnaphthalene-acrylic acid copolymer, an acrylic acid alkyl ester-acrylic acid copolymer, a methacrylic acid alkyl ester-methacrylic acid, a styrene-methacrylic acid alkyl ester-methacrylic acid copolymer, a styrene-acrylic acid alkyl ester-acrylic acid copolymer, a styrene-methacrylic acid phenyl ester-methacrylic acid copolymer, a styrene-methacrylic acid cyclohexyl ester-methacrylic acid copolymer, or the like.

These copolymers may be suitably copolymerized with a monomer having a polyoxyethylene group or a hydroxyl group. Moreover, a monomer having a cationic functional group, such as N,N-dimethylaminoethyl methacrylate, N,N-dimethylaminoethyl acrylate, N,N-dimethylaminomethacrylamide, N,N-dimethylaminoacrylamide, N-vinylpyrrole, N-vinylpyridine, N-vinylpyrrolidone, N-vinylimidazole, or the like can be suitably copolymerized.

As the above condensation polymer, a known polyester-based polymer may be mentioned. As the polyester-based polymer, there may be mentioned, for example, a polyester resin containing a carboxyl group obtained by reacting a polybasic carboxylic acid with a polyhydric alcohol under a condition that the carboxyl group is present in excess.

Specifically, as the polybasic carboxylic acid, there may be mentioned, for example, an aromatic dicarboxylic acid such as terephthalic acid, isophthalic acid, phthalic acid, 1,5-naphthalenedicarboxylic acid, 2,6-naphthalenedicarboxylic acid, or diphenic acid, an aliphatic dicarboxylic acid such as succinic acid, adipic acid, azelaic acid, sebacic acid, or dodecanedicarboxylic acid, an unsaturated aliphatic or alicyclic dicarboxylic acid such as fumaric acid, maleic acid, itaconic acid, hexahydrophthalic acid, or tetrahydrophthalic acid, or the like.

On the other hand, as the polyhydric alcohol, there may be mentioned an aliphatic diol such as ethylene glycol, propylene glycol, butylene glycol, or polyethylene glycol, an aliphatic polyhydric alcohol having three or more hydroxyl groups, such as trimethylol ethane, glycerin, or pentaerythritol, an alicyclic diol such as 1,4-cyclohexanediol, 1,4-cyclohexanedimethanol, spiro glycol, hydrogenated bisphenol A, tricyclodecane, or tricyclodecane dimethanol, an aromatic diol such as paraxylene glycol, metaxylene glycol, orthoxylene glycol, or 1,4-phenylene glycol, or the like.

Among the above components, the dicarboxylic acid and the diol are first reacted in excess of the hydroxyl group and then a tribasic or higher basic polybasic carboxylic acid such as trimellitic acid, trimesic acid, or pyromellitic acid is reacted with the end of the molecule, whereby a polyester resin having an appropriate acid value can be obtained.

The polyester-based polymer may also be a polyester resin containing a phosphoric acid group. The polyester resin containing a phosphoric acid group can be obtained by using at least one of phosphoric acid, pyrophosphoric acid, polyphosphoric acid, or phosphorous acid in the reaction process of the polyhydric alsohol compound and the polybasic carboxylic acid compound.

Furthermore, the polyester-based polymer may be a polyester resin containing a sulfonic acid group. As the polyester resin containing a sulfonic acid group, there may be mentioned, for example, a polyester resin containing a sulfonic acid group obtained using a dicarboxylic acid containing a sulfonic acid group, such as sulfoterephthalic acid, 5-sulfoisophthalic acid, 4-sulfophthalic acid, 4-sulfonaphthalene-2,7-dicarboxylic acid, or 5-[4-sulfophenoxy]isophthalic acid or a metal salt or an ammonium salt thereof and a polyhydric alcohol.

The polyester-based polymer may also be a polyurethane resin containing an acid group. The polyurethane resin containing an acid group is a polyurethane resin obtained by reacting an organic diisocyanate compound with a polymeric diol compound to synthesize a urethane prepolymer and then reacting it with a chain-extending agent and a reaction-terminating agent and there may be mentioned a polyurethane resin containing a carboxyl group wherein a compound having a carboxyl group is utilized as the polymeric diol compound, the chain-extending agent, or the like or a polyurethane resin containing a sulfo group wherein a compound having a sulfo group as the polymeric diol compound or the like.

As the organic diisocyanate compound for the polyurethane resin used as a water-soluble resin for the impregnation liquid according to the invention, isophoron diisocyanate or tetramethylxylylene diisocyanate is useful.

Moreover, as the polymeric diol compound containing a carboxyl group, an ethylene oxide adduct of dimethylolpropionic acid, a reaction product of polyethylene glycol with pyromellitic anhydride, or the like is useful. As the chain-extending agent having a carboxyl group, a diol compound containing a carboxyl group, such as dimethylol propionic acid is useful.

Furthermore, by using a polyester diol containing a sulfo group obtained by reacting the above dicarboxylic acid compound with a diol compound as the polymeric diol component, a polyurethane resin containing a sulfo group can be obtained.

Moreover, as the water-soluble resin, polystyrenesulfonic acid, polyacrylic acid, polymethacrylic acid, polyvinylsulfonic acid, polyalginic acid, a polyoxyethylene-polyoxypropylene-polyoxyethylene block copolymer, a formalin condensate of naphthalenesulfonic acid, polyvinylpyrrolidone, polyethyleneimine, a polyamine, a polyamide, polyvinylimidazoline, an aminoalkyl acrylate-acrylamide copolymer, chitosan, polyoxyethylene alkyl ether, polyoxyethylene alkylphenyl ether, a polyoxyethylene fatty acid amide, polyvinyl alcohol, polyacrylamide, a cellulose derivative such as carboxymethyl cellulose or carboxyethyl cellulose, a polysaccharide and a derivative thereof, or the like can be also effectively used in the invention.

The hydrophilic group of the water-soluble resin is not particularly limited but is preferably a carboxylic acid group or a group of carboxylic acid salt. Among these water-soluble resins, the copolymer wherein the hydrophilic group is an acidic group is preferably used in a state of a salt with a basic substance in order to enhance its solubility in water. As the basic substance forming a salt with these polymers, there may be mentioned an alkali metal such as sodium, potassium, or lithium, an aliphatic amine such as monomethylamine, dimethylamine, or triethylamine, an alcohol amine such as monomethanolamine, monoethanolamine, diethanolamine, triethanolamine, or diisopropanolamine, ammonia, or the like. Of these, a basic compound of an alkali metal such as sodium, potassium, or lithium can be suitably used. This is because an alkali metal is a strong electrolyte and thus has an effect of promoting dissociation of a hydrophilic group.

The water-soluble resin is preferably neutralized in a ratio of 50% or more relative to the acid value of the copolymer, more preferably neutralized in a ratio of 80% or more relative to the acid value of the copolymer. The water-soluble resin has preferably a weight-average molecular weight of 2,000 to 15,000, more preferably a weight-average molecular weight of 3,500 to 10,000. These water-soluble resins may be used solely or two or more thereof may be used in combination.

The impregnation liquid in the first embodiment of the invention can contain a water-soluble solvent in addition to at least one resin selected from the group consisting of the above water-hardly-soluble resin and water-soluble resin. As the water-soluble solvent, there may be mentioned, for example, a polyhydric alcohol such as glycerin, 1,2,6-hexanetriol, ethylene glycol, propylene glycol, diethylene glycol, triethylene glycol, tetraethylene glycol, dipropylene glycol, polyethylene glycol, 2-butene-1,4-diol, 2-ethyl-1,3-hexanediol, 2-methyl-2,4-pentanediol, 1,2-octanediol, 1,2-hexanediol, 1,6-hexanediol, 2,5-hexanediol, 1,2-pentanediol, 1,5-pentanediol, or 4-methyl-1,2-pentanediol, an alkyl alcohol having 1 to 5 carbon atoms such as methyl alcohol, ethyl alcohol, n-propyl alcohol, isopropyl alcohol, n-butyl alcohol, sec-butyl alcohol, tert-butyl alcohol, isobutyl alcohol, or n-pentanol, a glycol ether such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, diethylene glycol mono-n-butyl ether, triethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, dipropylene glycol mono-iso-propyl ether, propylene glycol mono-n-butyl ether, or dipropylene glycol mono-n-butyl ether, an amide such as dimethylformamide or dimethylacetamide, a ketone or a ketone alcohol such as acetone or diacetone alcohol, an ether such as dioxane, 2-pyrrolidone, N-methyl-2-pyrrolidone, sulfolane, or the like. These water-soluble solvents may be used solely or as a mixture of two or more thereof. Moreover, form the viewpoint of preventing the drying of the ink absorbed in the waste ink liquid absorber, at least one of these water-soluble solvents is preferably a high-boiling and low-vaporizing solvent whose vapor pressure at 20° C. is 0.01 mmHg or lower. More preferably, the vapor pressure at 20° C. is 0.005 mmHg or lower.

The impregnation liquid according to the invention may contain, for example, a solid moisturizing agent, a pH regulator, a surfactant, a antiseptic/antifungal agent, and the like in addition to at least one resin selected from the group consisting of the above water-hardly-soluble resins and water-soluble resins and the water-soluble solvent.

As the solid moisturizing agent, one having a melting point of 20° C. or higher and a solubility in water at 20° C. of 5% by weight or more is suitable. Specifically, there may be mentioned an alcohol such as 1,4-butanediol, 2,3-butanediol, or 2-ethyl-2-(hydroxymethyl)-1,3-propanediol, an ester such as ethylene carbonate, a nitrogen compound such as acetamide, N-methylacetamide, 2-pyrrolidone, ε-caprolactam, urea, thiourea, or N-ethylurea, dihydroxyacetone, erythritol, a sugar such as D-arabinose, L-arabinose, D-xylose, 2-deoxy-β-D-ribose, D-lyxose, L-lyxose, D-ribose, D-arabitol, ribitol, D-artrose, D-allose, D-galactose, L-galactose, D-quinovose, D-glucose, D-digitalose, D-digitoxose, D-cymarose, L-sorbose, D-tagatose, D-talose, 2-deoxy-D-glucose, D-fucose, L-fucose, D-fructose, D-mannose, L-rhamnose, D-inositol, myo-inositol, D-glucitol, D-mannitol, methyl=D-galactopyranoside, methyl=D-glucopyranoside, methyl=D-mannopyranoside, N-acetylchitobiose, isomaltose, xylobiose, gentiobiose, kojibiose, chondrosine, sucrose, cellobiose, sophorose, α,α-trehalose, maltose, melibiose, lactose, laminaribiose, rutinose, gentianose, stachyose, cellotriose, planteose, maltotriose, melezitose, lacto-N-tetraose, or raffinose.

As the pH regulator, there may be used an alkali metal hydroxide such as lithium hydroxide, potassium hydroxide, or sodium hydroxide, ammonia, an amine such as triethanolamine, tripropanolamine, diethanolamine, or monoethanolamine, or the like. Moreover, if necessary, there may be mentioned collidine, imidazole, phosphoric acid, 3-(N-morpholino)propanesulfonic acid, tris(hydroxymethyl) aminomethane, boric acid, or the like.

As the surfactant, an anionic surfactant, a cationic surfactant, an amphoteric surfactant, and a nonionic surfactant can be incorporated. Specific examples of the nonionic surfactant include an acetylene glycol-based surfactant, an acetylene alcohol-based surfactant, an ether-based one such as polyoxyethylene nonylphenyl ether, polyoxyethylene octylphenyl ether, polyoxyethylene dodecylphenyl ether, polyoxyethylene alkylaryl ether, polyoxyethylene oleyl ether, polyoxyethylene lauryl ether, polyoxyethylene alkyl ether, or polyoxyalkylene alkyl ether, an ester-based one such as polyoxyethylene oleic acid, polyoxyethylene oleic acid ester, polyoxyethylene distearic acid ester, sorbitan laurate, sorbitan monostearate, sorbitan monooleate, sorbitan sesquioleate, polyoxyethylene monooleate, or polyoxyethylene stearate, a silicone-based surfactant such as dimethylpolysiloxane, a fluorocarbon-based surfactant such as a fluoroalkyl ester, a perfluoroalkylcarboxylic acid salt, or the like. Among the above nonionic surfactants, an acetylene glycol-based surfactant or an acetylene alcohol-based surfactant is particularly preferred in view of little foaming and excellent deforming properties. Further specific examples of the acetylene glycol-based surfactant and acetylene alcohol-based surfactant include 2,4,7,9-tetramethyl-5-decyne-4,7-diol, 3,6-dimethyl-4-octyne-3,6-diol, 3,5-dimethyl-1-hexyne-3-ol, or the like. Commercial products are also available and there may be mentioned, for example, Surfynol 104, 82, 465, 485, TG from Air Products and Olfine STG, Olfine E1010 manufactured by Nissin Chemical industry Co., Ltd., and the like.

As the antiseptic/antifungal agents, there may be mentioned, for example, sodium benzoate, pentachlorophenol sodium, 2-pyridinethiol-1-oxide sodium, sodium sorbitate, sodium dehydroacetate, 1,2-benzisothiazoline-3-one (Proxcel BZ, Proxcel BD20, Proxcel GXL, Proxcel XL2, or Proxcel TN from Arch Chemicals Inc.), or the like.

In the first embodiment of the invention, the impregnation liquid is preferably an aqueous one. In this case, a main solvent component is water. Moreover, in this case, the impregnation liquid can be prepared by merely mixing at least one resin selected from the group consisting of the above water-hardly-soluble resins and water-soluble resins and optionally the same water-soluble solvent with water.

In the impregnation liquid of the first embodiment of the invention, the content of the water-hardly-soluble resin is not particularly limited as far as the generation of deposition of the pigment particles on the waste ink liquid absorber can be prevented or suppressed by supporting the impregnation liquid of the invention on the waste ink liquid absorber. The supporting amount of the water-hardly-soluble resin on the waste ink liquid absorber can be regulated according to the ink to be used.

Moreover, in the impregnation liquid of the first embodiment of the invention, the content of the water-soluble resin is also not particularly limited as far as the generation of deposition of the pigment particles on the waste ink liquid absorber can be prevented or suppressed by supporting the impregnation liquid of the invention on the waste ink liquid absorber. The lower limit of the supporting amount of the water-soluble resin on the waste ink liquid absorber is preferably 1 mg/g.

The use form of the above water-soluble solvent, solid moisturizing agent, pH regulator, surfactant, and/or antiseptic may be a simple body or a mixed liquid state. The mixing ratio may be suitably determined depending on impregnation workability onto the waste ink liquid absorber and kind of the pigment ink used and is not particularly limited as far as an aimed effect can be secured. For example, the pH regulator should be added in an amount so that the pH of the whole mixed solution is 7 or higher but the other conditions can be suitably determined according to the kind of the pigment ink used and the like. With regard to the amount of the antiseptic to be added, there arises no problem when the amount is enough to obtain a sufficient antiseptic effect.

Moreover, the impregnation liquid in the second embodiment of the invention contains at least a moisturizing agent and a base. Furthermore, the impregnation liquid may contain optionally an antiseptic.

As the moisturizing agent, preferred is one which has high moisturizing ability and moisture absorbability and is difficult to vaporize. As a preferred moisturizing agent, there may be mentioned a polyol having a vapor pressure at 20° C. of 0.01 mmHg or lower. More preferably, the vapor pressure at 20° C. is 0.005 mmHg or lower. As the polyol having a vapor pressure at 20° C. of 0.01 mmHg or lower, specifically, a polyhydric alcohol such as glycerin, diethylene glycol, triethylene glycol, tetraethylene glycol, 1,5-pentanediol, 1,6-hexanediol, 1,2,6-hexanetriol, propylene glycol, dipropylene glycol, tripropylene glycol, or polyethylene glycol or a sugar such as glucose, mannose, fructose, ribose, xylose, arabinose, lactose, galactose, maltose, cellobiose, sucrose, trehalose, maltotriose, or maltitol is preferred.

As the base, an alkanolamine and an inorganic base as well as an imidazole may be preferably mentioned. Specific examples of the alkanolamine include monoethanolamine, diethanolamine, triethanolamine, or monopropanolamine, dipropanolamine, tripropanolamine, and the like. For example, since triethanolamine has a vapor pressure at 20° C. of 0.01 mmHg, it possesses both characteristics as the moisturizing agent and the base in the impregnation liquid of the invention.

Specific examples of the inorganic base include lithium hydroxide, sodium hydroxide, potassium hydroxide, and the like.

Specific examples of the imidazole include imidazole, N-methylimidazole, 2-methylimidazole, 2-hydroxyimidazole, 4-hydroxyimidazole, 5-hydroxyimidazole, and the like.

Specific examples of the antiseptic include dichlorophen, hexachlorophen, 1,2-benzothiazoline-3-one, 3,4-isothiazoline-3-one, or 4,4-dimethyloxazolidine, alkylisothiazolone, chloroalkylisothiazolone, benzisothiazolone, bromonitro alcohol, chloroxylenol, and the like.

The use form of the above moisturizing agent, pH regulator, base, and/or antiseptic may be a simple body or a mixed liquid state. The mixing ratio may be suitably determined depending on impregnation workability onto the waste ink liquid absorber and kind of the pigment ink used and is not particularly limited as far as an aimed effect can be secured. For example, the base should be added in an amount so that the pH of the whole mixed solution is 7 or higher but the other conditions can be suitably determined according to the kind of the pigment ink used and the like. With regard to the amount of the antiseptic to be added, there arises no problem when the amount is enough to obtain a sufficient antiseptic effect.

The content of the moisturizing agent and base in the impregnation liquid in the second embodiment of the invention is not particularly limited as far as the waste ink can be easily absorbed on the waste ink liquid absorber by supporting the impregnation liquid of the invention on the absorber even when the waste ink has a foaming property. The content of the present impregnation liquid to be supported on the waste ink liquid absorber is preferably 3 g/g or more.

The following description of the impregnation liquid is common to the above first and second embodiments.

The impregnation liquid of the invention can be incorporated into the waste ink liquid absorber by applying it on the surface of the waste ink liquid absorber or by immersing the waste ink liquid absorber in the impregnation liquid filled into a vessel.

In the waste ink liquid absorber according to the invention, it is possible to impregnate the whole body of the waste ink liquid absorber with the above impregnation liquid but at least the portion including the contact surface with the waste ink is impregnated with the above impregnation liquid. For example, the portion including the contact surface with the waste ink is a contact surface with the waste ink-diffusing chamber 35 in the case of the waste ink liquid absorber 32 to be mounted on the waste liquid tank 15 of the embodiment shown in FIG. 4 and FIG. 5. Namely, of the six flat surfaces of the waste ink-diffusing chamber 35, three side surface and the upper surface excluding the bottom and one side surface formed by the collection vessel 31 are each the portion including the contact surface with the waste ink and each of these surfaces is impregnated with the above impregnation liquid. Moreover, also in the waste ink tank 100 of the embodiment shown in FIG. 1 and FIG. 2 and in the waste ink tank 180 of the embodiment shown in FIG. 3, the contact surfaces with the waste ink-diffusing chamber 104 or the waste ink-diffusing chamber 184 are each the portion including the contact surface with the waste ink and each of these surfaces is impregnated with the above impregnation liquid. Furthermore, in the case of the inkjet-type recording apparatus wherein margin-less printing is carried out, the surfaces where the waste ink conveyed via the trapping material provided on the platen comes into contact with the waste ink liquid absorber are each the portion including the contact surface with the waste ink and each of these surfaces is impregnated with the above impregnation liquid.

When the waste ink liquid absorber according to the invention has a waste ink liquid absorber protruded part, for example, as shown in FIG. 6 and FIG. 7, at the waste ink liquid absorber protruded part, at least the portion including the contact surface with the waste ink is impregnated with the above impregnation liquid. Alternatively, the whole waste ink liquid absorber protruded part may be impregnated with the above impregnation liquid.

The waste ink liquid absorber according to the invention may contain the above impregnation liquid in a wet state or in a dry state but a wet state is preferred.

(D) Ink Composition

The waste ink liquid absorber according to the invention can be used for waste ink treatment of any ink compositions to be used in inkjet recording methods, in particular, for waste ink treatment of an aqueous pigment ink composition, especially an aqueous pigment ink composition containing a water-insoluble dispersible polymer, e.g., an aqueous pigment ink composition described in Documents 1 or 2.

Namely, according to the invention, it is possible to obtain an inkjet-type recording apparatus having the waste ink liquid absorber as mentioned above and the ink composition to be mentioned below.

As the ink composition for which the waste ink liquid absorber according to the invention can be advantageously used, there is mentioned, for example, an ink composition containing at least (1) a pigment, (2) a polymer which includes the pigment and makes the above pigment dispersible in the ink composition and which has a hydrophobic group and a hydrophilic group and is substantially not dissolved in the ink composition, and (3) water as a main solvent.

As the pigment, an organic pigment conventionally used in the inkjet ink compositions. As the organic pigment, for example, an azo pigment (e.g., including an azo lake, an insoluble azo pigment, a condensed azo pigment, or a chelete azo pigment), a polycyclic pigment (e.g., a phthalocyanine pigment, a perylene pigment, a perynone pigment, an anthraquinone pigment, a quinacridone pigment, a dioxazine pigment, a thioindigo pigment, an isoindolinone pigment, or a quinophthalone pigment, or the like), a nitro pigment, a nitroso pigment, aniline black, or the like can be used.

As the cyan pigment used as a cyan ink composition, C. I. Pigment Blue 15:3, 15:4, and 60 and the like are preferably used. In particular, C. I. Pigment Blue 15:4 is preferred.

As the magenta pigment used as a magenta ink composition, C. I. Pigment Red 122, 202, 209 and Pigment Violet 19 and the like are preferably used. In particular, C. I. Pigment Red 122 and Pigment Violet 19 are preferred.

As the yellow pigment used as a yellow ink composition, C. I. Pigment Yellow 74, 93, 109, 110, 128, 138, 150, 151, 154, 155, and 180 and the like are preferably used.

The above polymer (2) has a hydrophobic group and a hydrophilic group, it includes the pigment but makes it dispersible in the ink composition, and the polymer is substantially not dissolved in the ink composition. The above polymer (2) preferably has an acid value of 30 to 125 KOHmg/g. More preferred lower limit is 50 KOHmg/g and more preferred upper limit is 100 KOHmg/g.

The above polymer (2) preferably has a number-average molecular weight of 1,000 to 200,000. More preferred lower limit is 3,000 and more preferred upper limit is 150,000. Furthermore, the above polymer (2) is adjusted to have a salt-forming ratio of a dissociating hydrophilic group (i.e., a carboxyl group), i.e., a neutralized ratio, of less than 100% during the pigment-including step or blending step of the ink composition to be mentioned below. The lower limit of the neutralized ratio is preferably 60% and the upper limit is preferably 95%.

The hydrophobic group contained in the above polymer (2) is one or more selected from alkyl groups, cycloalkyl groups, and aromatic rings. Preferred examples of the aromatic rings include aryl groups (e.g., a phenyl group, a naphthyl group, an anthryl group, and the like) and derivatives thereof. The hydrophilic group is preferably one or more selected from a carboxyl group, a sulfonic acid group, a hydroxyl group, an amino group, an amido group, and bases thereof. The above polymer (2) can be obtained from a monomer or oligomer containing an acryloyl group, a methacryloyl group, a vinyl group, or an allyl group having a double bond.

As the above polymer (2), for example, there may be mentioned a vinyl polymer obtained by polymerization of:

(A) 5 to 45% by weight of at least one monomer selected from a monomer A1 represented by the following formula (I):

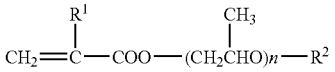

(I)

wherein R1 represents a hydrogen atom or a methyl group, R2 represents a hydrogen atom or an alkyl group having 1 to 20 carbon atoms, and n represents a numeral of 1 to 30;

a monomer A2 represented by the following formula (II):

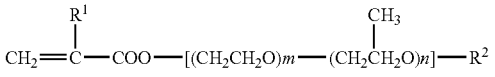

(II)

wherein R1, R2, and n represent the same meanings as defined in the formula (I), m represents a numeral of 1 to 30, and the oxyethylene group and oxypropylene group in the parenthesis [ ] may be any of block or random addition;

a monomer A3 represented by the following formula (III):

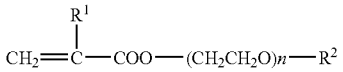

(III)

wherein R1, R2, and n represent the same meanings as defined in the formula (I);

(B) 3 to 40% by weight of a monomer having a salt-forming group;

(C) 5 to 40% by weight of a macromonomer having a number-average molecular weight of 500 to 500,000; and (D) 0 to 87% by weight of a monomer copolymerizable with the above monomers (A), (B), and (C).

As specific examples of the monomer A1, polypropylene glycol mono(meth)acrylate and the like may be mentioned and they may be used solely or as a mixture of two or more thereof. As specific examples of the monomer A2, ethylene glycol/propylene glycol(meth)acrylate, poly(ethylene glycol/propylene glycol)mono(meth)acrylate, and the like may be mentioned and they may be used solely or as a mixture of two or more thereof. Examples of commercially available monomer A1 or A2 include Blenmer PP-1000, PP-500, PP-800, AP-150, AP-400, AP-550, AP-800, 50PEP-300, 70PEP-350B, AEP series, 30PPT-800, 50PPT-800, 70PPT-800, APT series, 10PPB-500B, 10APB-500B, 50POEP-800B, 50AOEP-800B, ASEP series, PNEP series, PNPE series, 43ANEP-500, 70ANEP-550, and the like.

As specific example of the monomer A3, polyethylene glycol mono(meth)acrylate may be mentioned. Specific examples of commercially available monomer A3 include NK ester M-20G, 40G, 90G, 230G manufactured by Shin-Nakamura Chemical Co., Ltd., Blenmer PE series, PME-100, 200, 400, 1000 manufactured by NOF Corporation, and the like. The content of the (meth)acrylic acid ester monomer A in the vinyl polymer is from 5 to 45% by weight, preferably from 5 to 35% by weight from the viewpoint of print density and ink viscosity.

As the above salt-forming group-containing monomer (B), the use of an anionic monomer or a cationic monomer is preferred. The anionic monomer and cationic monomer may be used solely or as a mixture of two or more thereof.

As a specific example of an anionic monomer, an unsaturated carboxylic acid monomer, an unsaturated sulfonic acid monomer, or an unsaturated phosphoric acid monomer may be mentioned. Specific examples of the unsaturated carboxylic acid monomer include acrylic acid, methacrylic acid, crotonic acid, itaconic acid, maleic acid, fumaric acid, citraconic acid, 2-methacryloyloxymethyl succinate, and the like. From ink viscosity and injectability, an unsaturated carboxylic acid monomer is preferred and acrylic acid and methacrylic acid are more preferred.

As the cationic monomer, polyvinylamine, polyallylamine, N,N-dimethylaminoethyl acrylate, N,N-dimethylaminopropyl acrylate, and the like may be mentioned. In particular, N,N-dimethylaminoethyl acrylate and N,N-dimethylaminopropyl acrylate are preferred. The content of the salt-forming group-containing monomer (B) is from 3 to 40% by weight, preferably from 5 to 30% by weight from the viewpoint of dispersion stability and injection stability.

The above macromonomer (C) preferably has a polymerizable functional group at one end and the number-average molecular weight is more preferably from 1,000 to 10,000. As specific examples, there may be mentioned a styrene-based macromonomer having a polymerizable functional group at one end, a styrene/acrylonitrile-based macromonomer having a polymerizable functional group at one end, and the like and a styrene-based macromonomer having a polymerizable functional group at one end is preferred.

As a monomer constituting the styrene-based macromonomer other than styrene, acrylonitrile may be mentioned. Moreover, the content of styrene is preferably 60% by weight or more, more preferably 70% by weight or more from the viewpoint that the pigment is sufficiently incorporated into the vinyl polymer.

Among the styrene-based macromonomers having a polymerizable functional group at one end, those having an acryloyloxy group or a methacroyloxy group as the polymerizable functional group at one end are preferred. As commercially available styrene-based macromers, AS-6, AN-6, AN-6S, HS-6S, HS-6 manufactured by Toagosei Co., Ltd. and the like may be mentioned. The content of the macromer (C) is preferably from 0.1 to 40% by weight, more preferably from 1 to 30% by weight from the viewpoint of water resistance and abrasion resistance.

The above monomer (D) is copolymerizable with the above monomers (A), (B), and (C). As specific examples thereof, (meth)acrylic acid esters and aromatic ring-containing monomers and macromers may be mentioned. They may be used solely or as a mixture of two or more thereof. The monomer (D) preferably contains one or more selected from the group consisting of aromatic ring-containing monomers and macromers from the viewpoint of water resistance and abrasion resistance.

As the (meth)acrylic acid esters, there may be mentioned (meth)acrylic acid esters wherein the ester moiety is an alkyl group having 1 to 18 carbon atoms, e.g., methyl(meth)acrylate, ethyl(meth)acrylate, and (iso)propyl(meth)acrylate. As the aromatic ring-containing monomers, for example, styrene, α-methylstyrene, or vinyl toluene and vinyl naphthalene may be mentioned from the viewpoint of water resistance.

With regard to the amount of these monomers present in the vinyl monomer obtained by polymerizing the above monomers (A), (B), (C), and (D), the amount is from 5 to 45% by weight (preferably from 10 to 35% by weight) for the monomer (A), from 3 to 40% by weight (preferably from 5 to 35% by weight) for the monomer (B), from 5 to 40% by weight (preferably from 10 to 35% by weight) for the monomer (C), and from 0 to 87% by weight (preferably from 0 to 75% by weight) for the monomer (D). The weight-average molecular weight of the vinyl polymer is preferably from 3,000 to 300,000, more preferably from 5,000 to 200,000 from the view point of print density and injection stability.

The polymer particle dispersion including a pigment to be used in the above ink composition can be prepared specifically by the method described in JP-A-2001-247810. For example, it can be preferably prepared by the following steps. Namely, it comprises (1) a step of mixing a polymer solution dissolved in a water-soluble organic solvent (e.g., an alcohol, a ketone, an ether, or the like), a pigment, and, if necessary, a neutralizing agent to prepare a solvent dispersion; (2) a transfer-emulsifying step of introducing the dispersion into an aqueous phase to prepare an aqueous suspension; and (3) a step of removing the water-soluble organic solvent added at the solvent dispersion preparation by distillation to enclose a pigment with polymer particles.

The step of enclosing a pigment with polymer particles can be performed using a dispersing machine (e.g., ball mill, sand mill, attritor, roll mill, agitator mill, Henschen mixer, colloid mill, ultrasound homogenizer, jet mill, angmill, preferably high-pressure homogenizer).

The above polymer may be a vinyl polymer obtained by polymerization of:

(1) the above monomer A3;

(2) one or more monomers selected from the group consisting of the above monomer A1, the above monomer A2, and a monomer A4 represented by the following formula (IV):

(IV)

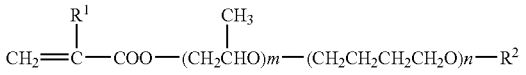

wherein R1, R2, m, and n represent the same meanings as defined above, and the oxyethylene group and the oxypropylene group may be in a form of block addition or random addition;

(3) the above monomer having a salt-forming group; and (4) a monomer copolymerizable with the above monomer A1, the above monomer A2, the above monomer A3, the above monomer A4, the above monomer (B), and the above monomer (C).

The vinyl polymer can be obtained, for example, by copolymerizing a monomer composition containing (1) 5 to 45% by weight of the above monomer A3, (2) 5 to 45% by weight of one or more monomers selected from the group consisting of the above monomer A1, the above monomer A2, and the above monomer A4, (3) 3 to 40% by weight of the monomer (B), and (4) 15 to 87% by weight of the copolymerizable monomer (D).

Specific examples of the monomer A4 include propylene glycol/tetramethylene glycol mono(meth)acrylate, poly(propylene glycol/tetramethylene glycol) mono(meth)acrylate, propylene glycol/polybutylene glycol mono(meth)acrylate, poly(propylene glycol/butylene glycol) mono(meth)acrylate, and the like. They may be used solely or as a mixture of two or more thereof.

The inkjet-type recording apparatus according to the invention is an inkjet-type recording apparatus equipped with a waste liquid tank which collects ink drops injected to a region other than a recording medium. The ink drops injected to a region other than a recording medium mean, for example, waste ink derived from flushing and cleaning or waste ink derived from margin-less printing.

As mentioned in the above, since the waste ink liquid absorber according to the invention contains the above impregnation liquid at least in the portion including a contact surface with an waste ink, the ink is easily absorbed even when the waste ink discharged from the waste liquid tube has a foaming property.

Moreover, when the waste ink liquid absorber according to the invention has a waste ink liquid absorber protruded part which extends toward the inside of the waste ink-diffusing chamber and the absorber protruded part contains the above impregnation liquid, the absorbability of the absorber is further enhanced.

EXAMPLES

The present invention is now illustrated in greater detail with reference to Examples and Comparative Examples, but it should be understood that the present invention is not to be construed as being limited thereto.

[1] Preparation of Color Ink Composition (1) Preparation of Polymer (I)

A monomer having the following composition was prepared.

| | |
|---|---|
| Propylene glycol monomethacrylate (n = 9) (a compound wherein R1 is methyl and R2 is hydrogen in the above formula (I). trade name: Blenmer PP-500, manufactured by NOF Corporation) | 15% by weight |
| Polyethylene glycol monomethacrylate (n = 23) (a compound wherein m is 23 and R1 and R2 each is methyl in the above formula (IV). trade name: NK ester M-230G, manufactured by Shin-Nakamura Chemical Co., Ltd.) | 10% by weight |
| Methacrylic acid | 14% by weight |
| Styrene monomer | 36% by weight |
| Styrene macromer (styrene-acrylonitrile copolymerized macromer, styrene content: 75% by weight, number-average molecular weight: 6000, functional group: methacryloyl group, trade name: AN-6, manufactured by Toagosei Co., Ltd.) | 15% by weight |
| n-Butyl methacrylate | 10% by weight |

Into a reaction vessel were filled 20 parts by weight of methyl ethyl ketone, 0.03 part by weight of a polymerization chain transfer agent (2-mercaptanethanol), and 10% of the total amount of the above monomer, and the whole was mixed. Then, the vessel was purged with nitrogen gas. On the other hand, the remaining 90% of the above monomer composition was filled into a dropping apparatus.

Then, 0.27% by weight of a polymerization chain transfer agent (2-mercaptanethanol), 60% by weight of methyl ethyl ketone, and 2,2'-azobis(2,4-dimethylvaleronitrile) were added to the dropping apparatus and the whole was mixed. Thereafter, the dropping apparatus was purged with nitrogen gas.

The temperature of the mixture in the reaction vessel was raised to 65° C. under stirring under a nitrogen atmosphere and the mixture in the dropping apparatus was added dropwise over a period of 3 hours. When 2 hours passed after the dropwise addition under 65° C., a solution of 0.3% by weight of 2,2'-azobis(2,4-dimethylvaleronitrile) dissolved in 5% by weight of methyl ethyl ketone was added. The mixture was aged at 65° C. for 2 hours and at 70° C. for further 2 hours to obtain a polymer solution.

A part of the polymer solution obtained as above was isolated by removing the solvent under reduced pressure to dryness, whereby a polymer (I) was obtained.

The weight-average molecular weight of the polymer (I) was determined by a gel permeation chromatography with chloroform containing dodecyldimethylamine in a concentration of 1 mm/l as a solvent using polystyrene as a standard substance. As a result, the weight-average molecular weight was found to be 70,000.

(2) Preparation of Pigment Dispersion (a) Preparation of Yellow Dispersion I

A polymer particle dispersion containing a yellow pigment was manufactured as follows. Namely, the polymer (I) manufactured in the above was dissolved in methyl ethyl ketone to form a 50% solution and 50 parts of the solution, 75 parts of C. I. Pigment Yellow 74, 300 parts of 0.05% potassium hydroxide, and 60 parts of methyl ethyl ketone were mixed and the mixture was stirred for 30 minutes in a homogenizer. Then, 300 parts of ion-exchange water was added and the whole was stirred for another 2 hours. After the whole amount of methyl ethyl ketone and a part of water were removed by distillation using a rotary evaporator, the residue was filtrated through a 0.3 μm membrane filter to obtain a yellow dispersion containing 20% by weight of solid mass.

(b) Preparation of Magenta Dispersion I

With regard to a polymer particle dispersion containing a magenta pigment, the magenta dispersion was obtained in the same manner as in the case of the yellow dispersion except that 80 parts of C. I. Pigment Violet 19 was used as a pigment and the amount of the 50% methyl ethyl ketone solution of the polymer (I) was changed to 40 parts.

(c) Preparation of Cyan Dispersion I

With regard to a polymer particle dispersion containing a cyan pigment, the cyan dispersion was obtained in the same manner as in the case of the yellow dispersion except that 50 parts of C. I. Pigment Blue 15:4 was used as a pigment and the amount of the 50% methyl ethyl ketone solution of the polymer (I) was changed to 100 parts.

[2] Preparation of Color Ink Composition

According to the composition shown in the following Table 1, the above yellow dispersion I, magenta dispersion I, or cyan dispersion I was mixed with solvents and ultrapure water and the mixture was stirred for 2 hours. Subsequently, the mixture was filtrated through a membrane filter having a pore size of about 1.2 μm (trade name; manufactured by Nihon Millipore Ltd.) to prepare a color ink composition. In Table 1, the amount of each component to be added was shown as % by weight.

TABLE 1

| | Color ink | | | | | |
|---|---|---|---|---|---|---|
| | Yellow A1 | Yellow A2 | Magenta A1 | Magenta A2 | Cyan A1 | Cyan A2 |
| Dispersion | 40 | 40 | 38 | 38 | 40 | 40 |
| Glycerin | 20 | 20 | 20 | 20 | 20 | 20 |
| Triethylene glycol | 4 | 2 | 4 | 2 | 4 | 2 |
| Trimethylol propane | — | 8 | — | 8 | — | 8 |
| 2-Pyrrolidone | 2 | 4 | 2 | 4 | 2 | 4 |
| Triethylene glycol monobutyl ether | 5 | 1 | 5 | 1 | 5 | 1 |
| 1,2-hexanediol | — | 3 | — | 3 | — | 3 |
| Surfynol 465 | 1 | 0.2 | 1 | 0.1 | 1 | 0.1 |
| Surfynol TG | 0.5 | 0.6 | 0.2 | 0.6 | 0.1 | 0.6 |
| Ultrapure water | balance | balance | balance | balance | balance | balance |

In Table 1, Surfynol 465 and Surfynol TG are trade names (manufactured by Air Products).

[3] Preparation of Ink Set

The yellow, magenta, and cyan inks obtained in the above [1] to [2] were combined as shown in the following Table 2 to prepare ink sets.

TABLE 2

| | Yellow | Magenta | Cyan |
|---|---|---|---|
| Ink set 1 | A1 | A1 | A1 |
| Ink set 2 | A2 | A2 | A2 |

Example 1-1

(1) Preparation of Reaction Product A

Into a 12 L flask equipped with a mechanical stirrer, a thermometer, an N2 inlet, a drying tube outlet, and an addition funnel were charged 4002 g of tetrahydrofuran (THF) and 7.7 g of p-xylene. Then, 2.0 mL of a 1.0M acetonitrile solution of tetrabutylammonium m-chlorobenzoate was added as a catalyst. As an initiator, 155.1 g (0.891M) of 1-methoxy-1-trimethylsiloxy-2-methylpropene was introduced. The feed of 2801 g (17.8M) of 2-dimethylaminoethyl methacrylate was started and the feed was carried out over a period of 45 minutes. After 100 minutes passed from the completion of the feed (more than 99% of the monomer reacted), the feed of 2045 g (14.4M) of butyl methacrylate was started and the feed was carried out over a period of 30 minutes. At the time when 400 minute passed, 310 g of dry methanol was added to the above solution and distillation was started. In total, 1725 g of solvent was removed. After the completion of the distillation, 1783 g of isopropanol was added. Thus, a butyl methacrylate/dimethylaminoethyl methacrylate (20/20) diblock polymer (solid mass=49.6%) was manufactured. Then, the polymer was neutralized with 2052 g (17.8M) of concentrated phosphoric acid and converted into water to manufacture a 15% solution of a reaction product A of polymer-based salt.

(2) Preparation of Emulsion

Inside the reactor were refluxed 233 g of water, 25 g of n-butyl methacrylate, and 25 g of the above reaction product A. At the time of refluxing, 27.5 g of water and 0.68 g of VA-044 (manufactured by Wako Pure Chemical Industries, Ltd.) were added. In another flask, 561 g of water, 225 g of n-butyl methacrylate, and 142 g of the reaction product A were thoroughly mixed using an Eppenbach homogenizer. Then, the above mixture was added to the reaction flask over a period of 100 minutes. When the completion of the addition of the above mixture, the content of the reaction flask was refluxed for another 60 minutes and then a mixture of water (12.5 g) and VA-044 (0.68 g) was added to the reaction flask. The content of the reaction flask was refluxed for another 60 minutes and then cooled to room temperature to obtain an emulsion. The solid mass in the resulting emulsion was found to be 23%. Thus, an emulsion A was obtained.

30% of the emulsion A prepared in the above, 54% of glycerin, 10% of triethylene glycol monobutyl ether, 5% of 1,2-hexanediol, 0.1% of 1,2-benzisothiazoline-3-one (Proxcel XL2; manufactured by Arch Chemicals Inc.), and 0.9% of triethanolamine were mixed to prepare an impregnation liquid 1-A.

Example 1-2

(1) Preparation of Reaction Product B

Into a 12 L flask equipped with a mechanical stirrer, a thermometer, an N2 inlet, a drying tube outlet, and an addition funnel were charged 3027 g of tetrahydrofuran (THF) and 6.2 g of p-xylene. Then, 2.5 mL of a 1.0M acetonitrile solution of tetrabutylammonium m-chlorobenzoate was added as a catalyst. As an initiator, 234.4 g of 1,1-bis(trimethylsiloxy)-2-methylpropene was introduced. The feed of 2.5 mL of a 1.0M acetonitrile solution of tetrabutylammonium m-chlorobenzoate was started and the whole amount was added over a period of 150 minutes. Then, the feed of 1580 g trimethylsilyl methacrylate was started and the whole amount was added over a period of 30 minutes. After 120 minutes passed from the completion of the above feed, the feed of 1425 g of butyl methacrylate and 503 g of methyl methacrylate was started and the whole amount was added over a period of 30 minutes. At the time when 320 minute passed, 650 g of dry methanol was added to the above solution and distillation was started. During the first stage of distillation, 1250.0 g of substances were removed from the flask. Then, 1182 g of isopropanol was added. Distillation was continued and 2792 g of the solvent was removed in total.

Thus, a butyl methacrylate/methyl methacrylate//methacrylic acid AB block polymer (10/5//10) having a number-average molecular weight (Mn) of 2,900 and a solid mass of 50.5% was manufactured. Then, 396 g of the polymer, 68 g of 2-amino-2-methyl-1-propanol (AMP), and 1536 g of deionized water were mixed together to form an aqueous solution of a reaction product B.

(2) Preparation of Emulsion

An emulsion was prepared by adding 637 g of methyl methacrylate and 63 g of n-butyl methacrylate to 700 g of the reaction product B prepared in the above (1) and 315 g of deionized water in a high-speed stirring apparatus (homogenizer). Until a mixture emulsified beforehand and containing a solid mass of at least 45% by weight was formed, stirring was continued for about 30 minutes. In a resin-made tank equipped with an air stirrer, a nitrogen inlet, a heating mantle, and a dropping funnel in which the emulsified mixture was placed, polymerization was carried out in an experimental scale. Deionized water was added to the tank in an amount so that solid mass of the final product was 25%. Air in the tank was replaced by nitrogen and water was heated to 70 to 72° C. Then, one tenth of the mixture emulsified beforehand, a 2% aqueous solution of sodium bisulfite, a 6.5% by weight aqueous solution of 0.25% of ammonium persulfate (based on the weight of the monomer used in the emulsified mixture) were added to the resin-made tank. The temperature was raised to 80° C. and the temperature was maintained during the polymerization. The remaining emulsified mixture and a sodium bisulfite solution were added over a period of 75 minutes. The total amount of the bisulfite added was 0.14% based on the monomer concentration. Twice amount of aqueous ammonium persulfate solution was prepared and was added in three portions. The first addition was performed at a midterm of the addition of the emulsified mixture and sodium sulfite, the second addition was performed at the time when the addition of these substances was completed, and the third addition was performed 15 minutes later. The resulting latex was kept at 80 to 85° C. for 120 minutes and then cooled and filtrated. Thus, an emulsion B was obtained.

15% of the emulsion B prepared in the above, 50% of glycerin, 30% of polyethylene glycol #400, 4% of 1,2-hexanediol, 0.3% of 1,2-benzisothiazoline-3-one (Proxcel XL2;

manufactured by Arch Chemicals Inc.), and 0.7% of triethanolamine were mixed to prepare an impregnation liquid 1-B.

Example 1-3

10% of a styrene/acrylic copolymer resin (Johncryl 631; manufactured by Johnson Polymer K.K.) as a water-hardly-soluble resin, 1% of tripropanolamine, and 89% of water were mixed to prepare an impregnation liquid 1-C.

Example 1-4

10% of a styrene/acrylic copolymer resin (Johncryl 790; manufactured by Johnson Polymer K.K.) as a water-hardly-soluble resin, 0.1% of potassium hydroxide, 0.1% of 1,2-benzisothiazoline-3-one (Proxcel XL2; manufactured by Arch Chemicals Inc.), and 89.8% of water were mixed to prepare an impregnation liquid 1-D.

Example 2-1

Into a four-neck flask equipped with a stirrer, a cooling tube, and a nitrogen gas inlet tube was charged 350 parts of butyl acetate and the whole was heated to 105° C. Under introduction of nitrogen gas, a mixture of 31 parts of methacrylic acid, 129 parts of methyl methacrylate, 40 parts of stearyl methacrylate, and 5 parts of benzoyl peroxide as an initiator was added dropwise over a period of 2 hours. After the copolymerization was continued for 2 hours with maintaining the same temperature, butyl acetate was removed by distillation to obtain an acrylic copolymer resin having a weight-average molecular weight of 11,000 and an acid value of 100 mgKOH/g.

10 parts of the acrylic copolymer resin was dissolved under heating in 90 parts of an aqueous sodium hydroxide solution wherein sodium hydroxide was dissolved in an amount corresponding to 100% of the amount for neutralizing the copolymer, whereby an aqueous water-soluble resin solution A was prepared, which was regarded as an impregnation liquid 2-A.

Example 2-2

Into a four-neck flask equipped with a stirrer, a cooling tube, and a nitrogen gas inlet tube was charged 350 parts of butyl acetate and the whole was heated to 105° C. Under introduction of nitrogen gas, a mixture of 20 parts of acid phosphonyl methacrylate, 120 parts of methyl methacrylate, 60 parts of butyl methacrylate, and 5 parts of benzoyl peroxide as an initiator was added dropwise over a period of 2 hours. After the copolymerization was continued for 2 hours with maintaining the same temperature, butyl acetate was removed by distillation to obtain an acrylic copolymer resin having a weight-average molecular weight of 12,000 and an acid value of 165 mgKOH/g.

10 parts of the acrylic copolymer resin was dissolved under heating in 90 parts of an aqueous triethanolamine solution wherein triethanolamine was dissolved in an amount corresponding to 100% of the amount for neutralizing the copolymer, whereby an aqueous water-soluble resin solution B was prepared, which was regarded as an impregnation liquid 2-B.

Example 2-3

Into a four-neck flask equipped with a stirrer, a cooling tube, and a nitrogen gas inlet tube was charged 350 parts of butyl acetate and the whole was heated to 105° C. Under introduction of nitrogen gas, a mixture of 95 parts of methacrylic acid, 65 parts of methyl methacrylate, 40 parts of stearyl methacrylate, and 5 parts of benzoyl peroxide as an initiator was added dropwise over a period of 2 hours. After the copolymerization was continued for 2 hours with maintaining the same temperature, butyl acetate was removed by distillation to obtain an acrylic copolymer resin having a weight-average molecular weight of 11,000 and an acid value of 310 mgKOH/g.

10 parts of the acrylic copolymer resin was dissolved under heating in 90 parts of an aqueous potassium hydroxide solution wherein potassium hydroxide was dissolved in an amount corresponding to 100% of the amount for neutralizing the copolymer, whereby an aqueous water-soluble resin solution C was prepared, which was regarded as an impregnation liquid 2-C.

Example 2-4

10% of an aqueous acrylic copolymer resin solution containing an acrylic copolymer resin (Johncryl 62; manufactured by Johnson Polymer K.K.) as a water-soluble resin, 70% of glycerin, 1% of tripropanolamine, 0.1% of 1,2-benzisothiazoline-3-one (Proxcel XL2; manufactured by Arch Chemicals Inc.), and 18.9% of water were mixed to prepare an aqueous water-soluble resin solution D, which was regarded as an impregnation liquid 2-D.

Example 2-5

10% of the aqueous water-soluble resin solution A prepared in the above Example 2-1, 60% of glycerin, 5% of triethylene glycol mono-n-butyl ether, 5% of 2-ethyl-2-(hydroxymethyl)-1,3-propanediol, and 20% of water were mixed to prepare an aqueous water-soluble resin solution E, which was regarded as an impregnation liquid 2-E.

Example 2-6

5% of the aqueous water-soluble resin solution B prepared in the above Example 2-2, 5% of an aqueous acrylic copolymer resin solution (Johncryl 62; manufactured by Johnson Polymer K.K.), 80% of 1,2,6-hexanetriol, and 10% of water were mixed to prepare an aqueous water-soluble resin solution F, which was regarded as an impregnation liquid 2-F.

Example 2-7

30% of the aqueous water-soluble resin solution C prepared in the above Example 2-3, 44% of glycerin, 20% of triethylene glycol, 5% of 1,2-hexanediol, 0.1% of 1,2-benzisothiazoline-3-one (Proxcel XL2; manufactured by Arch Chemicals Inc.), and 0.9% of triethanolamine were mixed to prepare an aqueous water-soluble resin solution G, which was regarded as an impregnation liquid 2-G.

Example 3-1

An impregnation liquid 3-A containing 99% of triethylene glycol as a moisturizing agent and 1% of diethanolamine as a base was manufactured.

Example 3-2

An impregnation liquid 3-B containing 79.9% of tetraethylene glycol as a moisturizing agent, 0.1% of sodium hydroxide as a base, and 20% of water was manufactured.

Example 3-3

Triethanolamine as a moisturizing agent and a base was used as an impregnation liquid 3-C.

Example 3-4

An impregnation liquid 3-D containing 99% of 1,2,6-hexanetriol as a moisturizing agent and 1% of N-methylimidazole as a base was manufactured.

Example 3-5

An impregnation liquid 3-E containing 49.8% of Mabit (trade name: Hayasibara Shoji Inc.) containing maltitol as a moisturizing agent, 0.1% of lithium hydroxide as a base, 0.1% of Denicide BIT (trade name: manufactured by Nagase ChemteX Corp.) containing benzisothiazolone as an antiseptic, and 50% of water was manufactured.

Example 3-6

An impregnation liquid 3-F containing 98.7% of glycerin as a moisturizing agent, 1% of triethanolamine as a base, and 0.3% of Proxcel XL2 (product name: manufactured by Avecia Ltd.) containing 1,2-benzothiazoline-3-one as an antiseptic was manufactured.

Example 3-7

An impregnation liquid 3-G containing 79.4% of polyethylene glycol #400 as a moisturizing agent, 0.5% of triethanolamine as a base, 0.1% of Proxcel GXL (product name: manufactured by Avecia Ltd.) containing 1,2-benzothiazoline-3-one as an antiseptic, and 20% of water was manufactured.

Example 3-8

An impregnation liquid 3-H containing 79.8% of polyethylene glycol #200 as a moisturizing agent, 0.1% of sodium hydroxide as a base, 0.1% of Denicide CSA (trade name: manufactured by Nagase ChemteX Corp.) containing 4,4-dimethyloxazolidine as an antiseptic, and 20% of water was manufactured.

Example 3-9

An impregnation liquid 3-I containing 49.8% of Mabit (trade name: Hayasibara Shoji Inc.) containing maltitol as a moisturizing agent, 0.1% of lithium hydroxide as a base, 0.1% of Denicide BIT (trade name: manufactured by Nagase ChemteX Corp.) containing benzisoothiazolone as an antiseptic, and 50% of water was manufactured.

Example 3-10

An impregnation liquid 3-J containing 98.7% of glycerin as a moisturizing agent, 1% of triethanolamine as a base, and 0.3% of Proxcel XL2 (product name: manufactured by Avecia Ltd.) containing 1,2-benzotiazoline-3-one as an antiseptic was manufactured.

Comparative Examples 1 and 2

Incidentally, as Comparative Example 1, there was used a waste ink liquid absorber A into which no permeable component was impregnated. As Comparative Example 2, there was used a waste ink liquid absorber A into which pure water was impregnated.

Evaluation Example of Physical Properties (1) Waste Ink Liquid Absorber A and B

Using a waste ink liquid absorber possessing no waste ink liquid absorber protruded part and a waste ink liquid absorber possessing a waste ink liquid absorber protruded part, cleaning treatment was performed. Specifically, a waste ink liquid absorber of the embodiment shown in FIG. 4 and FIG. 5 (hereinafter referred to as "waste ink liquid absorber A") and a waste ink liquid absorber having a protruded part shown in FIG. 6 and FIG. 7 (hereinafter referred to as "waste ink liquid absorber B") were used.

(2) Impregnation Liquid

Each of the impregnation liquids prepared in Examples 1-1 to 1-4, 2-1 to 2-7, and 3-1 to 3-10 was used to homogeneously impregnate the waste ink liquid absorbers A and B in an impregnation amount of 5 g/g.

(3) Cleaning Treatment of Waste Liquid

Each of the above waste ink liquid absorbers A and B was mounted on an inkjet printer [PX-V700 (trade name): manufactured by Seiko Epson Corp.] and an ink cartridge filled with the above ink set 1 or 2 was loaded on the color line. For the black ink line, a standard ink cartridge for PX-V700 was used as it was. Cleaning of waste liquid was repeated every 6 hours under an environment of 40° C. and 20% relative humidity and the number of times until the waste liquid was deposited to finally block the waste liquid tube was measured. The results from the evaluation according to the following four stages of judging standard are shown in Table 3.

Judgment AA: The waste tube is not blocked even when cleaning of waste liquid is performed 41 times or more.

A: The number of cleaning times until the waste tube is blocked is from 31 times to 40 times.

B: The number of cleaning times until the waste tube is blocked is from 21 times to 30 times.

C: The waste tube is blocked only when cleaning of waste liquid is performed 20 times or less.

TABLE 3

| | Ink set | Impregnation liquid | Waste ink liquid absorber | Judgment |
|---|---|---|---|---|
| Example 1-1 | 1 | 1-A | A | A |
| Example 1-2 | 2 | 1-B | B | AA |
| Example 1-3 | 1 | 1-A | A | B |
| Example 1-4 | 2 | 1-A | A | B |
| Example 2-1 | 1 | 2-A | A | B |
| Example 2-2 | 2 | 2-B | A | B |
| Example 2-3 | 1 | 2-C | A | A |
| Example 2-4 | 2 | 2-D | A | A |
| Example 2-5 | 1 | 2-E | A | A |
| Example 2-6 | 2 | 2-F | B | AA |
| Example 2-7 | 1 | 2-G | B | AA |
| Example 3-1 | 1 | 3-A | A | B |
| Example 3-2 | 2 | 3-B | A | B |
| Example 3-3 | 1 | 3-C | A | B |
| Example 3-4 | 2 | 3-D | A | B |
| Example 3-5 | 1 | 3-E | A | B |
| Example 3-6 | 2 | 3-F | A | A |

TABLE 3-continued

| | Ink set | Impregnation liquid | Waste ink liquid absorber | Judgment |
|---|---|---|---|---|
| Example 3-7 | 1 | 3-G | A | A |
| Example 3-8 | 2 | 3-H | A | A |
| Example 3-9 | 1 | 3-I | B | A |
| Example 3-10 | 2 | 3-J | B | AA |
| Comparative Example 1 | 1 | None | A | C |
| Comparative Example 2 | 2 | Pure water | A | C |

Since the waste ink liquid absorber according to the invention can easily absorb an waste ink liquid even when the waste ink discharged from a waste liquid tube has a foaming property, the absorber can be effectively utilized for an inkjet-type recording apparatus wherein flushing and cleaning or marginless printing is performed.

While the present invention has been described in detail and with reference to specific embodiments thereof, it will be apparent to one skilled in the art that various changes and modifications can be made therein without departing from the spirit and scope thereof.

What is claimed is:

1. A waste ink liquid absorber for a waste ink tank of an inkjet-type recording apparatus, which comprises:

an impregnation liquid containing at least one selected from the group consisting of a water-hardly-soluble resin; a water-soluble resin; and both of a moisturizing agent and a base, the impregnation liquid being included in at least a surface coming into contact with a waste ink.

2. The waste ink liquid absorber according to claim 1, wherein the water-hardly-soluble resin contains a water-hardly-soluble resin obtained by polymerizing at least one monomer selected from the group consisting of acrylic monomers, methacrylic monomers, vinylic monomers, maleic acid, maleic anhydride, styrene, itaconic acid, N-vinylpyrrolidone, acrylamide, methacrylamide, and derivatives thereof.

3. The waste ink liquid absorber according to claim 2, wherein the methacrylic monomer is at least one monomer selected from the group consisting of methyl methacrylate (MMA), ethyl methacrylate (EMA), propyl methacrylate, n-butyl methacrylate (BMA or NBMA), hexyl methacrylate, 2-ethylhexyl methacrylate (EHMA), octyl methacrylate, lauryl methacrylate (LMA), stearyl methacrylate, phenyl methacrylate, hydroxyethyl methacrylate (HEMA), hydroxypropyl methacrylate, ethoxytriethylene glycol methacrylate (ETEGMA), 2-ethoxyethyl methacrylate, methacrylonitrile, 2-trimethylsiloxyethyl methacrylate, glycidyl methacrylate (GMA) p-tolyl methacrylate, methacrylic acid (MMA), diethylaminoethyl methacrylate (DMAEMA), diethylaminoethyl methacrylate, t-butylaminoethyl methacrylate, and sorbyl methacrylate.

4. The waste ink liquid absorber according to claim 2, wherein the acrylic monomer is at least one monomer selected from the group consisting of methyl acrylate, ethyl acrylate, propyl acrylate, butyl acrylate, hexyl acrylate, 2-ethylhexyl acrylate, octyl acrylate, lauryl acrylate, stearyl acrylate, phenyl acrylate, hydroxyethyl acrylate, hydroxypropyl acrylate, acrylonitrile, 2-trimethylsiloxyethyl acrylate, glycidyl acrylate, p-tolyl acrylate, sorbyl acrylate, acrylic acid, dimethylaminoethyl acrylate, and diethylaminoethyl acrylate.

5. The waste ink liquid absorber according to claim 1, wherein the water-soluble resin is a compound having a hydrophilic structural part and a hydrophobic structural part.

6. The waste ink liquid absorber according to claim 1, wherein the moisturizing agent is a polyol having a vapor pressure at 20 C of 0.01 mmHg or lower.

7. The waste ink liquid absorber according to claim 1, wherein the base is an alkanolamine or an inorganic base.

8. The waste ink liquid absorber according to claim 1, which further contains a water-soluble solvent.

9. The waste ink liquid absorber according to claim 8, wherein at least one of the water-soluble solvent has a vapor pressure at 20 C of 0.01 mmHg or lower.

10. The waste ink liquid absorber according to claim 1, wherein the impregnation liquid further contains an antiseptic.

11. The waste ink liquid absorber according to claim 1, which comprises a nonwoven fabric or a foam.

12. The waste ink liquid absorber according to claim 11, wherein the nonwoven fabric contains a regenerated cellulose fiber and/or a polyacrylic fiber.

13. The waste ink liquid absorber according to claim 11, which has a saturated polyester film layer on at least a part of the surface.

14. A waste ink tank comprising:

a waste ink-diffusing chamber not to be packed with a waste ink liquid absorber; and an absorber-supporting chamber to be packed with a waste ink liquid absorber, the waste ink liquid absorber according to claim 1 being packed into the absorber-supporting chamber.

15. The waste ink tank according to claim 14, which the waste liquid absorber has a waste ink liquid absorber protruded part extending from the surface of the waste ink liquid absorber toward the inside of the waste ink-diffusing chamber, and wherein the waste ink liquid absorber protruded part contains at least the impregnation liquid.

16. The waste ink tank according to claim 15, wherein the waste ink liquid absorber protruded part is formed of a polyurethane foam.

17. The waste ink tank according to claim 14, wherein the waste ink-diffusing chamber is surrounded by a bottom of the waste ink tank, an upper surface of the waste ink liquid absorber, and four side surfaces thereof.

18. An inkjet-type recording apparatus comprising:

the waste ink liquid absorber according to claim 1; and an ink composition containing at least:

a pigment;

a polymer containing the pigment, enabling the pigment to disperse in the ink composition, having a hydrophobic group and a hydrophilic group, and being substantially not dissolved in the ink composition; and water as a main solvent.

19. The inkjet-type recording apparatus according to claim 18, wherein the polymer is a vinyl polymer obtained by polymerizing:

(A) 5 to 45% by weight of at least one monomer selected from:

monomer A1 represented by the following formula (I):

(I)

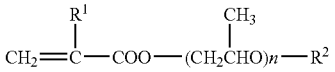

wherein $R^1$ represents a hydrogen atom or a methyl group, $R^2$ represents a hydrogen atom or an alkyl group having 1 to 20 carbon atoms, and n represents a numeral of 1 to 30;

a monomer A2 represented by the following formula (II):

(II)

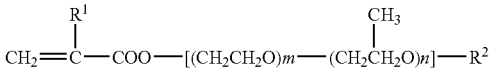

wherein $R^1$, $R^2$, and n represent the same meanings as defined in the formula (I), m represents a numeral of 1 to 30, and the oxyethylene group and oxypropylene group in the parenthesis [ ] may be any of block or random addition; and a monomer A3 represented by the following formula (III):

(III)

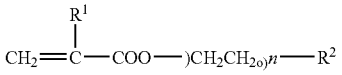

wherein $R^1$, $R^2$, and n represent the same meanings as defined in the formula (I);

(B) 3 to 40% by weight of a monomer having a salt-forming group;

(C) 5 to 40% by weight of a macromonomer having a number-average molecular weight of 500 to 500,000; and (D) 0 to 87% by weight of a monomer copolymerizable with the monomers (A),(B), and (C).

20. The inkjet-type recording apparatus according to claim 18, wherein the polymer is a vinyl polymer obtained by polymerizing:

(1) the monomer A3; and (2) at least one monomer selected from the group consisting of the monomer A1, the monomer A2 and a monomer A4 represented by the following formula (IV):

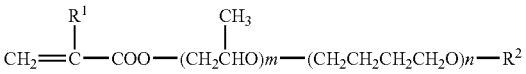

wherein $R^1$, $R^2$, m, and n represent the same meanings as defined above, and the oxyethylene group and the oxypropylene group is in a form of block addition or random addition;

(3) the monomer (B) having a salt-forming group; and (4) a monomer copolymerizable with the monomers A1, A2, A3, A4, (B), and (C).

21. An ink jet recording apparatus comprising:

(a) an ink comprising a pigment as colorant; and (b) a waste ink tank comprising a waste ink liquid absorber, the waste ink liquid absorber comprising (i) a material for absorbing a waste liquid comprising ink not ejected by the ink jet recording apparatus onto a recording medium for recording, and (ii) an impregnation liquid, impregnated in the material, that prevents or suppresses particles of the pigment in the ink from forming a deposit on a surface of the waste ink liquid absorber when the waste liquid is absorbed by the material, said impregnation liquid comprising at least (a) a water-hardly-soluble resin, (b) a water-soluble resin or (c) a moisturizing agent and a base.

* * * * *